US007497552B2

(12) United States Patent
Ikeda

(10) Patent No.: US 7,497,552 B2
(45) Date of Patent: Mar. 3, 2009

(54) LIQUID DROPLET EJECTING APPARATUS

(75) Inventor: Kenji Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/823,363

(22) Filed: Jun. 27, 2007

(65) Prior Publication Data

US 2008/0150986 A1 Jun. 26, 2008

(30) Foreign Application Priority Data

Dec. 25, 2006 (JP) ..... 2006-347866

(51) Int. Cl.
*B41J 2/15* (2006.01)
*B41J 2/145* (2006.01)

(52) U.S. Cl. ..... 347/40; 347/43; 347/49

(58) Field of Classification Search ..... 347/40–43, 347/49, 20

See application file for complete search history.

(56) References Cited

U.S. PATENT DOCUMENTS

2006/0274099 A1* 12/2006 Jahana et al. ..... 347/15

FOREIGN PATENT DOCUMENTS

JP 2006-88568 4/2006

OTHER PUBLICATIONS

R.P. Dooley, "Prediction Brightness Appearance at Edge Using Linear and Non-Linear Visual Describing Functions," SPSE Annual Meeting 1975.

* cited by examiner

*Primary Examiner*—Thinh H Nguyen
(74) *Attorney, Agent, or Firm*—Fildes & Outland, P.C.

(57) ABSTRACT

A liquid droplet ejecting apparatus includes: a first liquid droplet ejecting head that is formed by joining together plural units at which nozzles that eject liquid droplets are two-dimensionally arranged; and a second liquid droplet ejecting head that is formed by joining together plural units at which nozzles that eject liquid droplets are two-dimensionally arranged, with an overlap width of the nozzles between units at joined portions of the units being greater in the second liquid droplet ejecting head than in the first liquid droplet ejecting head.

12 Claims, 24 Drawing Sheets

CAMPBELL'S PATTERN

FIG.23

| | | TRAPEZOIDAL ARRAY | | | | | | | | | RECTANGULAR ARRAY | | | | | | | | |
|---|---|---|---|---|---|---|---|---|---|---|---|---|---|---|---|---|---|---|---|
| NOISE | DIFFERENCE IN DROPLET QUANTITY OF UNIT | 5% | 8% | 10% | 8% | | | 8% | | | 5% | 8% | 10% | 8% | | | 8% | | |
| | SHIFT IN ATTACHMENT POSITION OF UNIT | 10 μm | | | 5 μm | 10 μm | 20 μm | 10 μm | | | 10 μm | | | 5 μm | 10 μm | 20 μm | 10 μm | | |
| | VARIATION IN PAPER FEEDING SPEED | 0.002% | | | 0.002% | | | 0.001 % | 0.002 % | 0.004 % | 0.002% | | | 0.002% | | | 0.001 % | 0.002 % | 0.004 % |
| IMAGE QUALITY | DENSITY FLUCTUATION | ○ | ○ | △ | ○ | ○ | ○ | ○ | ○ | △ | ○ | △ | × | △ | △ | △ | △ | △ | △ |
| | LINE/CHARACTER IMAGE | △ | △ | △ | △ | △ | × | ○ | △ | × | ○ | ○ | ○ | ○ | ○ | ○ | ○ | ○ | △ |

ASSUMING: 600 dpi, PAPER CONVEYANCE SPEED OF 22.5 inches/sec., 1024 NOZZLES PER UNIT

○ : GOOD
△ : NOT VERY GOOD
× : POOR

LIQUID DROPLET EJECTING APPARATUS

CROSS-REFERENCE TO RELATED APPLICATION

This application is based on and claims priority under 35 USC 119 from Japanese Patent Application No. 2006-347866 filed Dec. 25, 2006.

BACKGROUND

1. Technical Field

The present invention relates to a liquid droplet ejecting apparatus.

2. Related Art

As liquid droplet ejecting apparatus, inkjet recording apparatus that eject ink droplets to record an image on a recording medium are known.

SUMMARY

According to an aspect of the invention, there is provided a liquid droplet ejecting apparatus including: a first liquid droplet ejecting head that is formed by joining together plural units at which nozzles that eject liquid droplets are two-dimensionally arranged; and a second liquid droplet ejecting head that is formed by joining together plural units at which nozzles that eject liquid droplets are two-dimensionally arranged, with an overlap width of the nozzles between units in joined portions of the units being greater in the second liquid droplet ejecting head than in the first liquid droplet ejecting head.

BRIEF DESCRIPTION OF THE DRAWINGS

An exemplary embodiment of the present invention will be described in detail based on the following figures, wherein:

FIG. 23 is a result table where image defects with respect to noise are compared in regard to the inkjet recording head where the nozzles are arrayed in a rectangular shape and the inkjet recording head where the nozzles are arrayed in a trapezoidal shape.

DETAILED DESCRIPTION

Herebelow, an example of an exemplary embodiment of the present invention will be described in detail with reference to the drawings.

In the present exemplary embodiment, an inkjet recording apparatus that ejects ink droplets to record an image on a recording medium will be described as an example of a liquid droplet ejecting apparatus that ejects liquid droplets.

It will be noted that the liquid droplet ejecting apparatus is not limited to an apparatus that ejects ink. For example, the liquid droplet ejecting apparatus may be a color filter manufacturing apparatus that ejects ink or the like onto film or glass to manufacture a color filter, an apparatus that ejects molten solder onto a substrate to form bumps for mounting parts, an apparatus that ejects liquid metal to form a wiring pattern, or any type of film forming apparatus that ejects liquid droplets to form a film; it suffices as long as the liquid droplet ejecting apparatus ejects liquid droplets.

Figure 1:
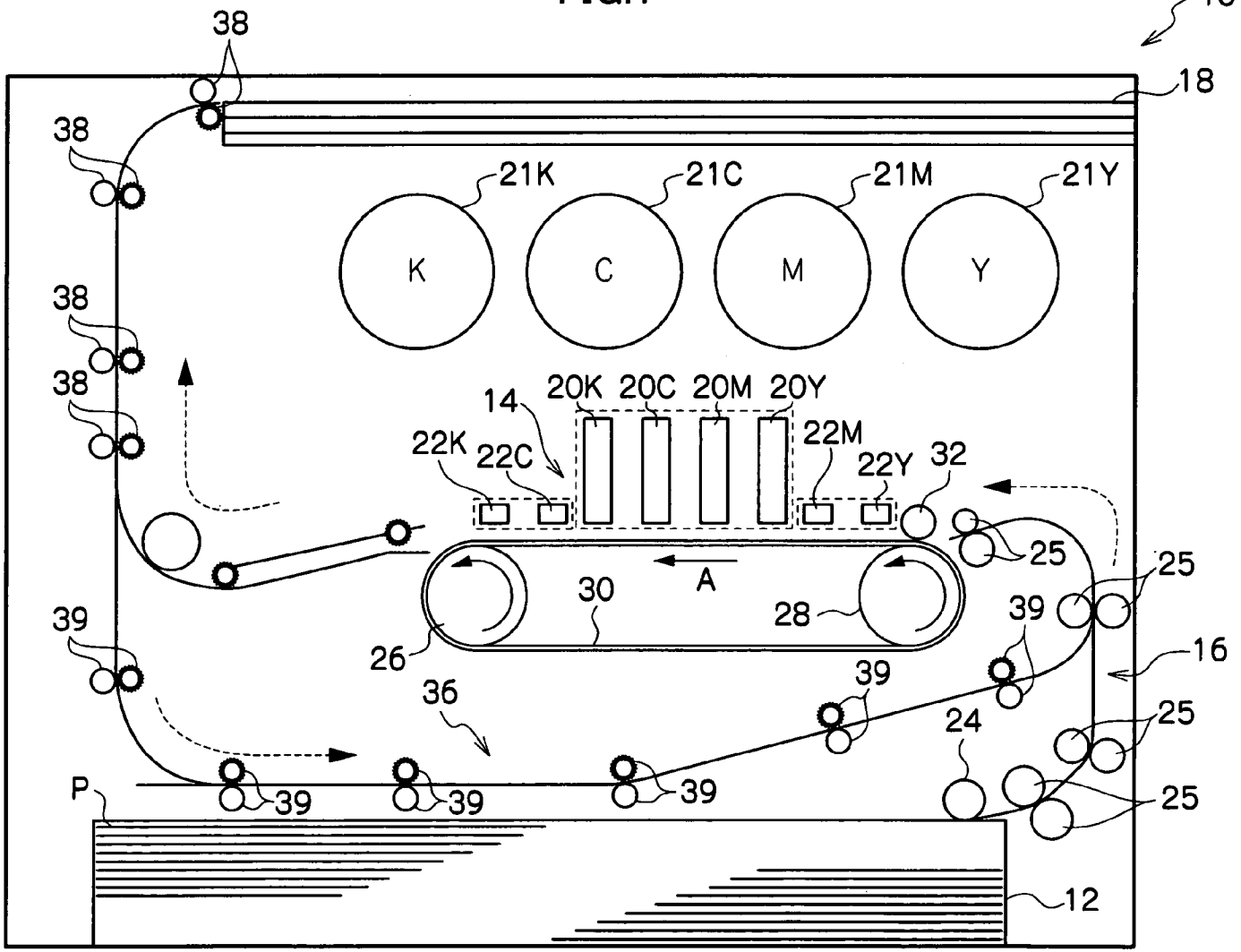
FIG. 1 is a general diagram showing the overall configuration of an inkjet recording apparatus pertaining to the exemplary embodiment of the present invention.
Figure 2:
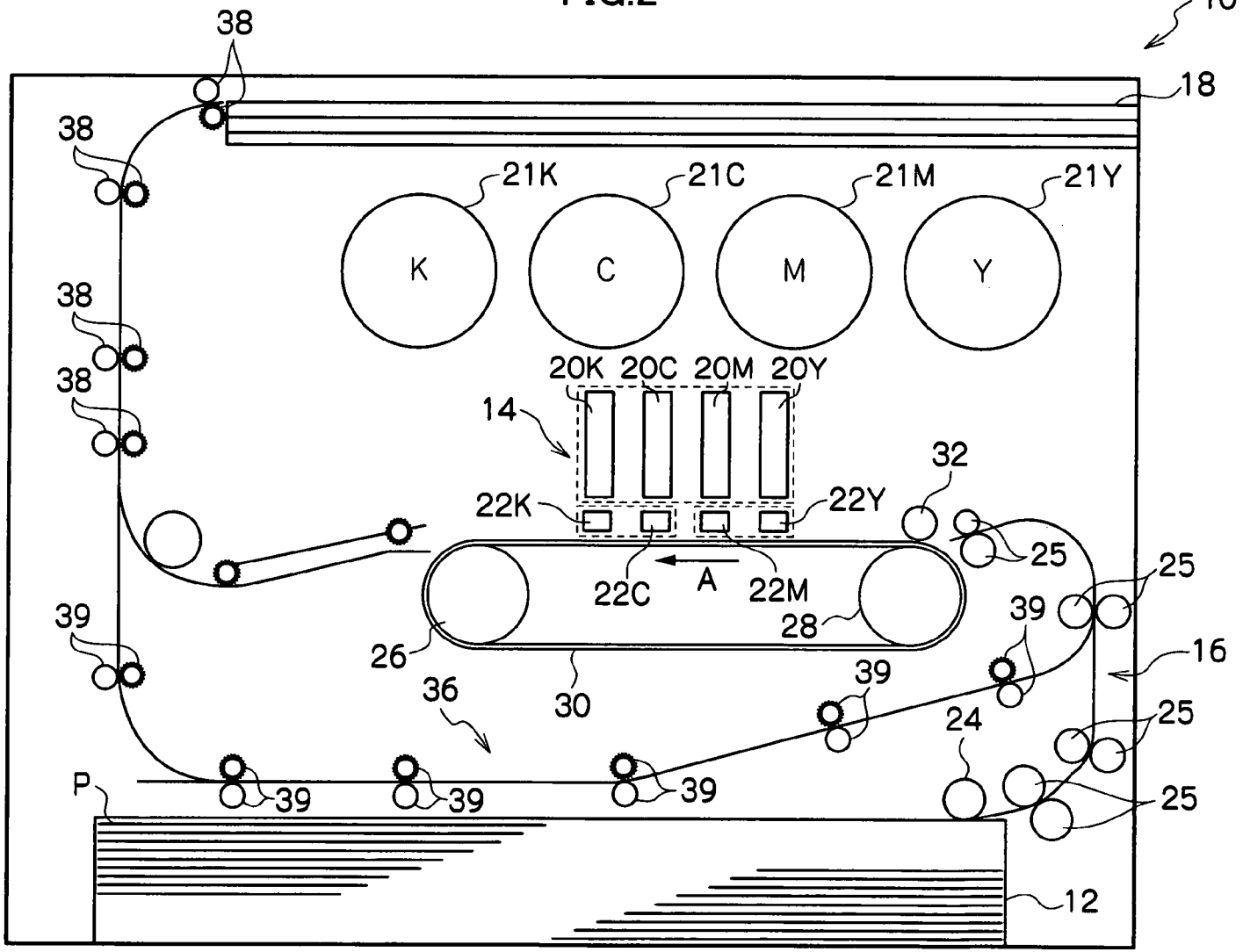
FIG. 2 is a general diagram showing a state where, in the inkjet recording apparatus pertaining to the exemplary embodiment, maintenance units are in opposing positions where they oppose inkjet recording heads.

Overall Configuration of Inkjet Recording Apparatus Pertaining to the Present Exemplary Embodiment First, the overall configuration of an inkjet recording apparatus 10 pertaining to the present exemplary embodiment will be described. In FIG. 1 and FIG. 2, the overall configuration of the inkjet recording apparatus 10 pertaining to the present exemplary embodiment is shown in general view.

As shown in FIG. 1 and FIG. 2, the inkjet recording apparatus 10 is disposed with a recording medium storage section 12 in which a recording medium P such as paper is stored, an image recording section 14 that records an image on the recording medium P, conveying unit 16 that conveys the recording medium P from the recording medium storage section 12 to the image recording section 14, and a recording medium discharge section 18 to which the recording medium P on which an image has been recorded by the image recording section 14 is discharged.

The image recording section 14 is disposed with inkjet recording heads 20Y, 20M, 20C and 20K (indicated as "20Y to 20K" below) that eject ink droplets to form an image on the recording medium P.

The inkjet recording heads 20Y to 20K are arranged in the order of the colors of yellow (Y), magenta (M), cyan (C) and black (K) from upstream in the conveyance direction of the recording medium P. The inkjet recording heads 20Y to 20K record an image by utilizing thermal or piezoelectric system to eject ink droplets corresponding to these colors from nozzle surfaces where plural nozzles are formed.

The image-recordable width of each of the inkjet recording heads 20Y to 20K is configured to be equal to or greater than the width of the recording region of the recording medium P. The "width" referred to here is a length in a direction intersecting the conveyance direction of the recording medium P.

Ink tanks 21Y, 21M, 21C and 21K that store inks are disposed in the inkjet recording apparatus 10. The inks are supplied from the ink tanks 21Y, 21M, 21C and 21K to the inkjet recording heads 20Y to 20K. Various types of inks—such as water-based inks, oil-based inks and solvent-based inks—may be used as the inks supplied to the inkjet recording heads 20Y to 20K.

Maintenance units 22Y, 22M, 22C and 22K (indicated as "22Y to 22K" below) that perform maintenance with respect to the inkjet recording heads 20Y to 20K are also disposed in the inkjet recording apparatus 10. The maintenance units 22Y to 22K are configured to be movable between an opposing position (see FIG. 2) where they oppose the nozzle surfaces of the inkjet recording heads 20Y to 20K and a retracted position (see FIG. 1) where they are retracted from the nozzle surfaces of the inkjet recording heads 20Y to 20K.

Each of the maintenance units 22Y to 22K includes a cap that covers the nozzle surfaces of the inkjet recording heads 20Y to 20K, a receiving member that receives preliminarily ejected (empty-ejected) liquid droplets, and a cleaning member that cleans the nozzle surfaces of the inkjet recording heads 20Y to 20K. When the maintenance units 22Y to 22K are to perform maintenance with respect to the inkjet recording heads 20Y to 20K, the inkjet recording heads 20Y to 20K rise a predetermined height, and the maintenance units 22Y to 22K move to the opposing position and perform various types of maintenance.

The conveying unit 16 is disposed with a feed roll 24 that feeds the recording medium P stored in the recording medium storage section 12, conveyance roll pairs 25 that nip and convey the recording medium P fed by the feed roll 24, and an endless conveyor belt 30 that causes the recording surface of the recording medium P conveyed by the conveyance roll pairs 25 to face the inkjet recording heads 20Y to 20K.

The conveyor belt 30 is wrapped around a drive roll 26 disposed downstream in the conveyance direction of the recording medium P and a driven roll 28 disposed upstream in the conveyance direction of the recording medium P. The conveyor belt 30 is configured to cyclically move in a predetermined direction (the direction of arrow A in FIG. 1).

A pressing roll 32 that presses the recording medium P against the conveyor belt 30 is disposed above the driven roll 28. The pressing roll 32 follows the conveyor belt 30 and doubles as a charging roll. The conveyor belt 30 is charged by the pressing roll 32, whereby the recording medium P is electrostatically attracted to and conveyed on the conveyor belt 30.

The conveyor belt 32 conveys the recording medium P, whereby the inkjet recording heads 20Y to 20K and the recording medium P relatively move, ink droplets are ejected onto the relatively moving recording medium P, and an image is formed.

It will be noted that the inkjet recording heads 20Y to 20K may be configured to move with respect to the recording medium P, or the recording medium P and the inkjet recording heads 20Y to 20K may be configured to relatively move.

Further, the conveyor belt 30 is not limited to a configuration that electrostatically attracts and holds the recording medium P and may also have a configuration that holds the recording medium P by friction with the recording medium P or non-electrostatic manner such as suction or adhesion.

A release claw that releases the recording medium P from the conveyor belt 30 is disposed downstream of, so as to be capable of moving toward and away from, the conveyor belt 30. The recording medium P on which an image has been recorded by the inkjet recording heads 20Y to 20K is released from the conveyor belt 30 by the curvature of the conveyor belt 30 and the release claw. It will be noted that illustration of the release claw is omitted in FIG. 1 and FIG. 2.

Plural conveyance roll pairs 38, whose sides facing the recording surface of the recording medium P comprise star wheels, are disposed downstream of the release claw. The recording medium P on which an image has been recorded by the image recording section 14 is conveyed by the conveyance roll pairs 38 to the recording medium discharge section 18.

An inversion section 36 that inverts the recording medium P is disposed below the conveyor belt 30. Once the conveyance roll pairs 38 convey the recording medium P downstream, the conveyance roll pairs 38 reversely rotate so that the recording medium P is sent to the inversion section 36.

Plural conveyance roll pairs 39, whose sides facing the recording surface of the recording medium P comprise star wheels, are disposed in the inversion section 36. The recording medium P sent to the inversion section 36 is again sent to the conveyor belt 30.

Figure 10A:
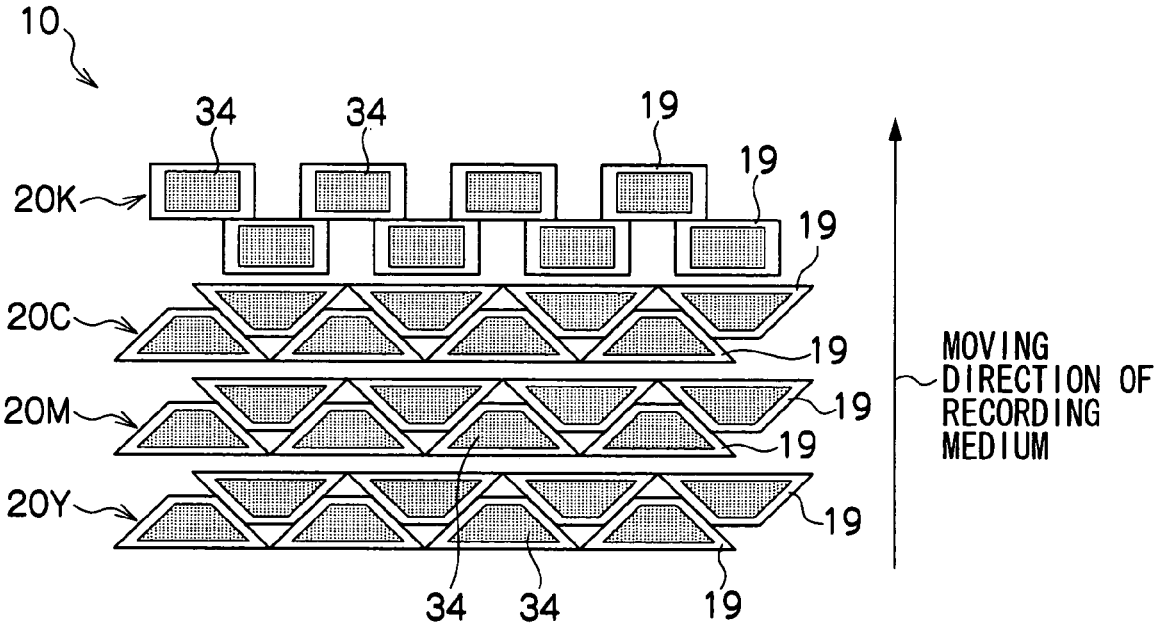
FIG. 10A is a diagram showing the configuration of inkjet recording heads pertaining to the exemplary embodiment.
Figure 10B:
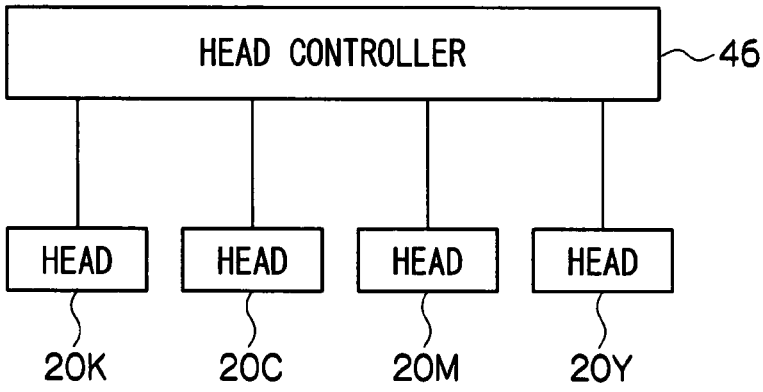
FIG. 10B is a block diagram showing a control system that controls operation of the inkjet recording heads pertaining to the exemplary embodiment.

The inkjet recording apparatus 10 is also disposed with a head controller 46 serving as a control unit that controls operation of the inkjet recording heads 20Y to 20K (see FIG. 10B).

The head controller 46 is connected to the inkjet recording heads 20Y to 20K, determines the ejection timing of the ink droplets in accordance with image data inputted from the outside and the nozzles of the inkjet recording heads 20Y to 20K to be used, and applies drive signals to those nozzles. Although it is not illustrated, the inkjet recording apparatus 10 is also disposed with system control unit that controls operation of the entire inkjet recording apparatus 10.

Next, image recording operation of the inkjet recording apparatus 10 will be described.

First, the recording medium P is fed from the recording medium storage section 12 by the feed roll 24 and is sent to the conveyor belt 30 by the conveyance roll pairs 25 upstream of the conveyor belt 30.

The recording medium P sent to the conveyor belt 30 is attracted to and held on a conveyance surface of the conveyor belt 30, conveyed to a recording position of the inkjet recording heads 20Y to 20K, and an image is recorded on the recording surface of the recording medium P. Then, after image recording ends, the recording medium P is released from the conveyor belt 30 by the release claw.

When an image is to be recorded on just one side of the recording medium P, then the recording medium P is discharged to the recording medium discharge section 18 by the conveyance roll pairs 38 downstream of the conveyor belt 30.

When an image is to be recorded on both sides of the recording medium P, then after an image has been recorded on one side, the recording medium P is inverted by the inversion section 36 and again sent to the conveyor belt 30. An image is then recorded on the opposite side of the recording medium P in the same manner as described above, whereby an image is recorded on both sides of the recording medium P, and the recording medium P is discharged to the recording medium discharge section 18.

Technical Explanation for the Present Exemplary Embodiment

Here, technical explanation for the present exemplary embodiment will be described.

First, visual characteristics relating to image density will be described.

Figure 3:
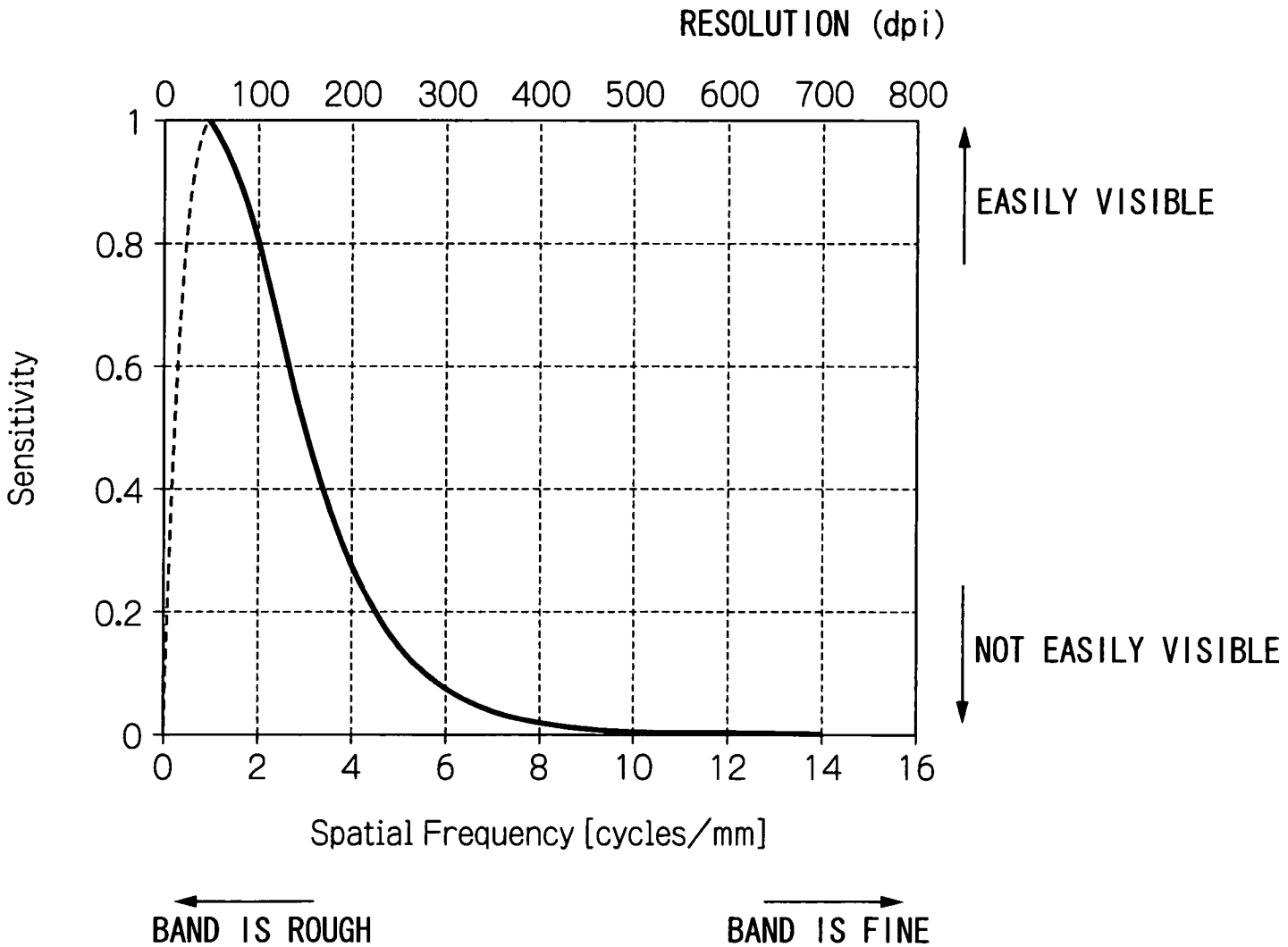
FIG. 3 is a graph showing a function representing the discriminating ability of human vision relating to image density.

In regard to the discriminating ability of human vision relating to image density—that is, whether or not differences in density can be seen—as a visual transfer function (VTF) there is the function represented by the graph shown in FIG. 3.

Figure 4:
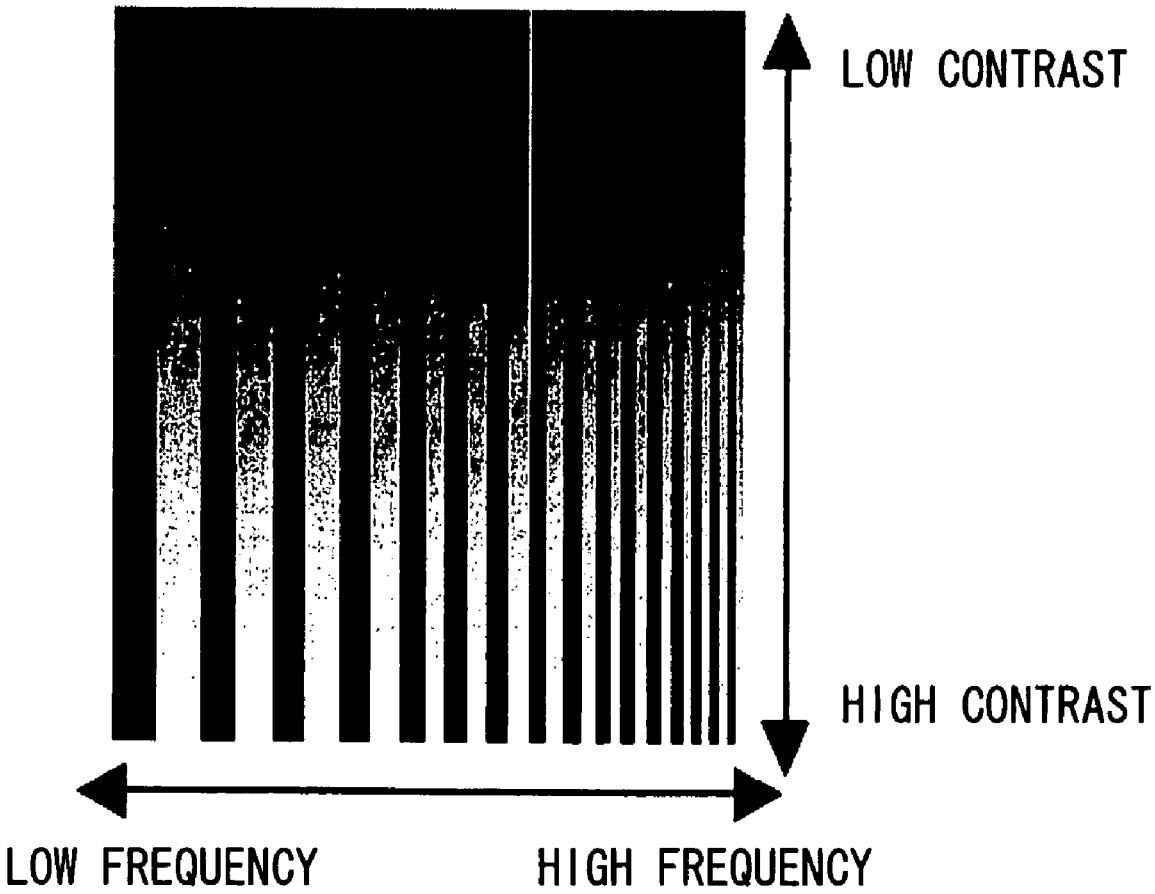
FIG. 4 is a diagram showing Campbell's pattern.

When seen from about 30 cm away, sensitivity is high with respect to a density fluctuation of 1 cycle/mm, and density fluctuation is easily seen. At a frequency higher than 1 cycle/mm, that is, when the bands are fine and narrow bands repeat, it becomes difficult for density fluctuation to be seen. This is something that has been researched using the test pattern shown in FIG. 4, that is, Campbell's pattern, and has been determined from the sight limit of the contrast of strip-like bands. As a reference, there is R. P. Dooley, "Prediction Brightness Appearance at Edge Using Linear and Non-Linear Visual Describing Functions," SPSE Annual Meeting 1975.

Next, the visual characteristics of a line image will be described.

Study that is the same as that of visual characteristics relating to the aforementioned image density is possible also with respect to line images.

Figure 5:
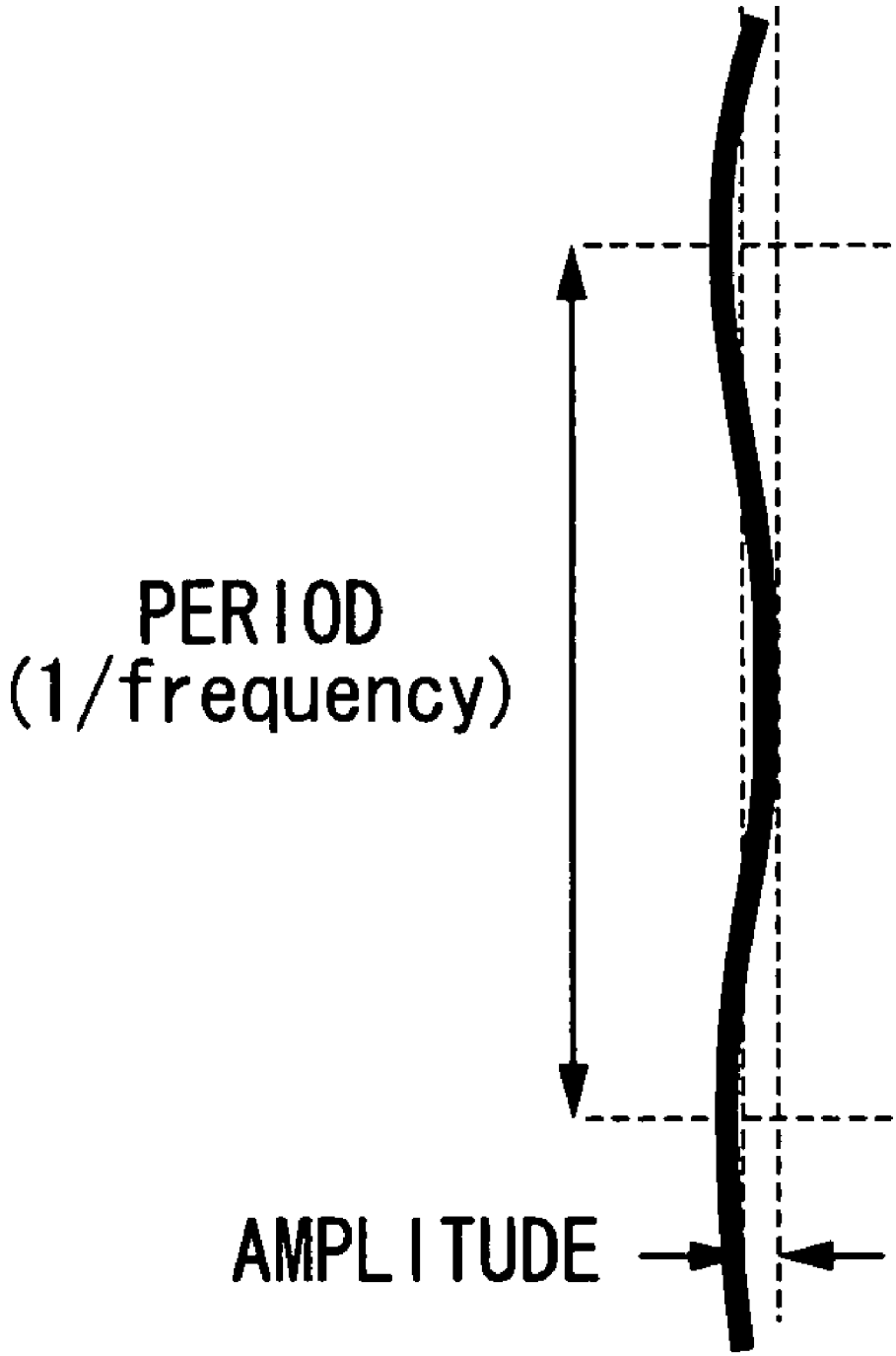
FIG. 5 is a diagram showing a line whose amplitude and frequency are defined in a line image.
Figure 6:
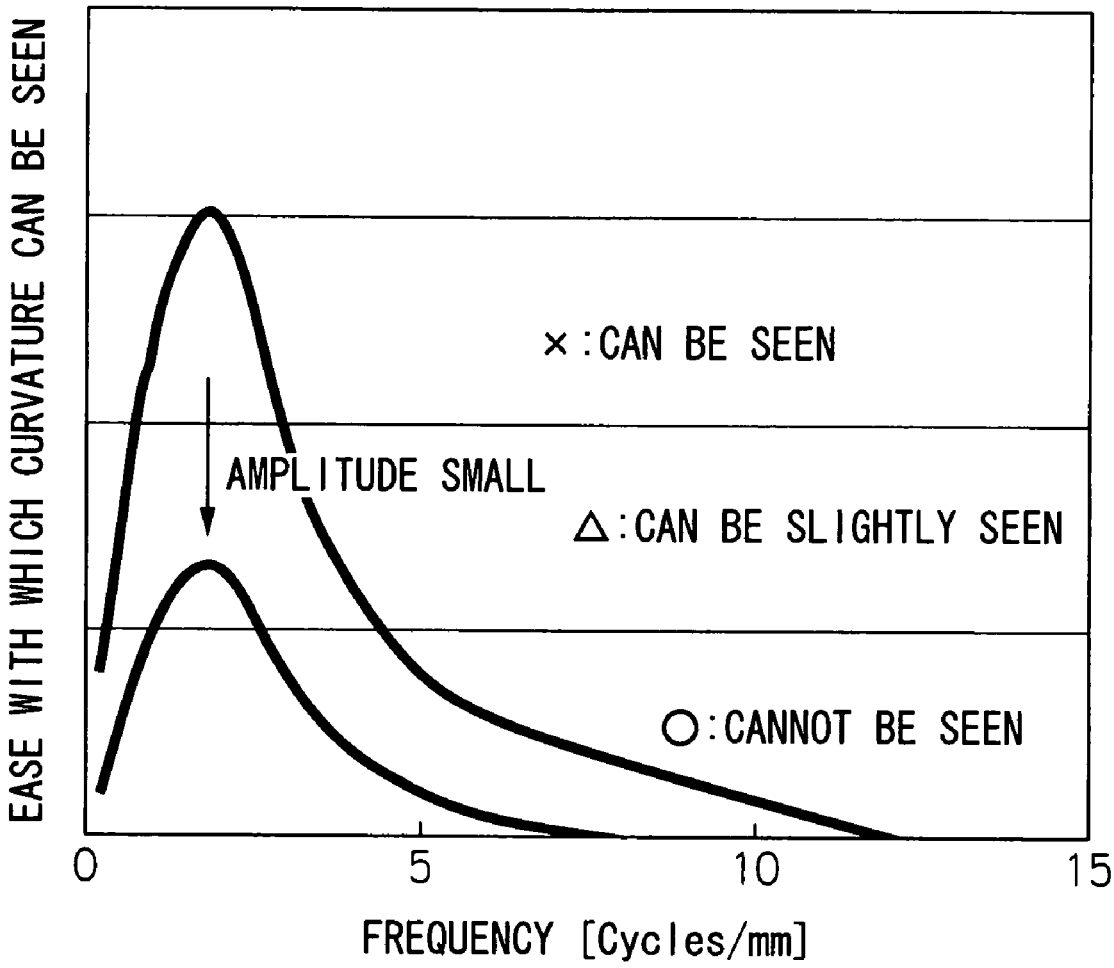
FIG. 6 is a graph showing visual characteristics of a line image.

As shown in FIG. 5, numerous lines whose amplitude and frequency are defined are created changing their amplitude and frequency, and up to which amplitude and frequency the lines could be seen is studied. As a result, as shown in FIG. 6, when the frequency of curvature is raised similarly to density fluctuation, the curvature becomes fine and unable to be recognized beyond the resolution of vision.

Further, the swelling of the lines also looks smooth on the low frequency side, and differences with a straight line become small and unable to be recognized. That visibility clearly drops even on the low frequency side is the difference with density fluctuation.

Further, that the number of swells becomes fewer also no longer causes the badness of defects to be felt. Of course, when the amplitude is made smaller, the entire graph drops to the bottom and it becomes difficult for the swelling of the lines to be recognized. As will be described later, the present exemplary embodiment particularly utilizes the property that it becomes difficult for defects to be perceived when the number of swells on the low frequency side becomes fewer.

Next, a cause of density fluctuation in an image will be described.

Figure 7:
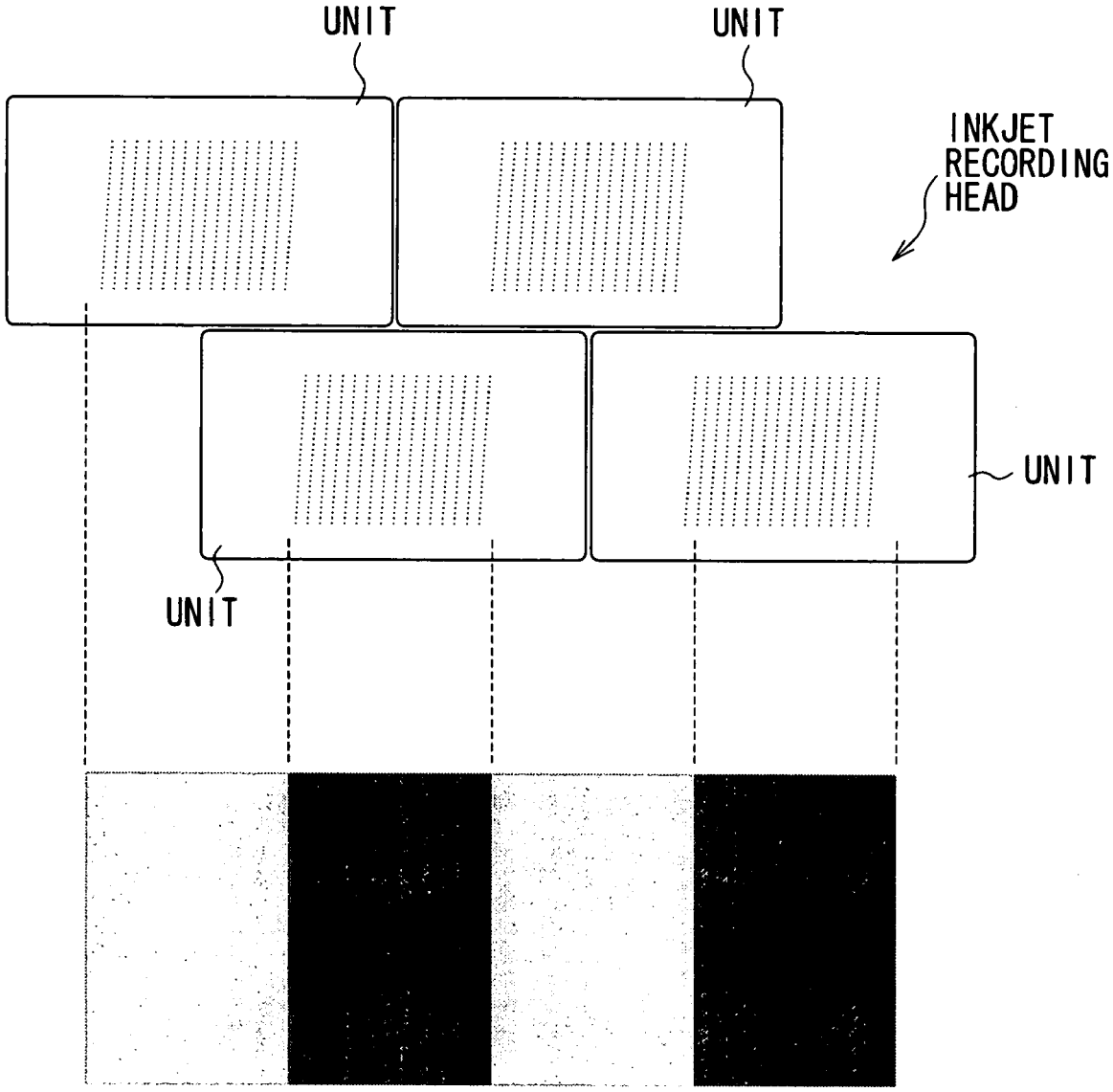
FIG. 7 is a diagram showing density fluctuation arising due to differences in liquid droplet quantity ejected per unit configuring an inkjet recording head.

The main cause of density fluctuation in an image results from the liquid droplet quantities of ink droplets ejected from nozzles per certain region being different. By "per certain region" is meant per unit configuring an inkjet recording head as shown in FIG. 7, for example. Liquid droplet quantities change as a result of the sizes of piezoelectric elements in the case of piezoelectric inkjet technology being different or as a result of there being differences in flow path resistance depending on whether the flow paths are on the basal side or the distal end side.

These all lead to density fluctuation at low frequencies. Here, density fluctuation that varies over time, density fluctuation resulting from variations in temperature, for example, and stripe fluctuation resulting from defective ejection will not be considered.

Next, a cause of line curvature in an image will be described.

The main cause of line curvature is when the moving speed of the recording medium varies such that the landing positions of liquid droplets on the recording medium differ depending on the place of the nozzle row.

Figure 8A:
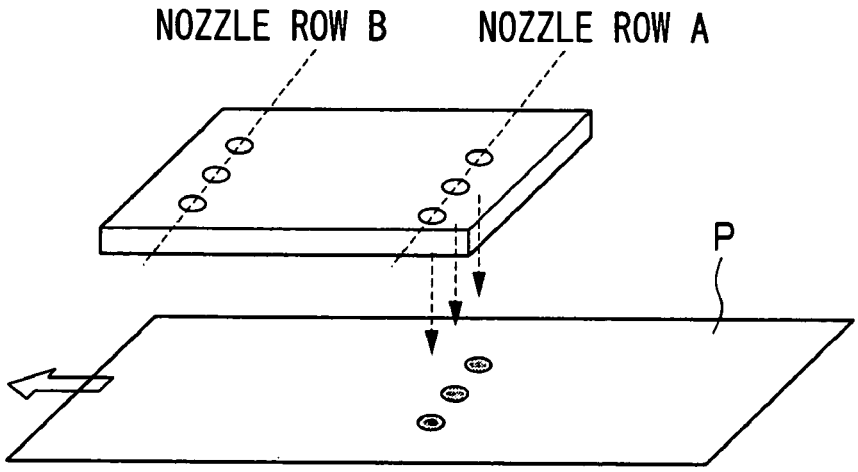
FIG. 8A and FIG. 8B are diagrams showing an instance where the moving speed of a recording medium does not vary when straight lines are recorded by two-dimensionally arranged nozzles.
Figure 8B:
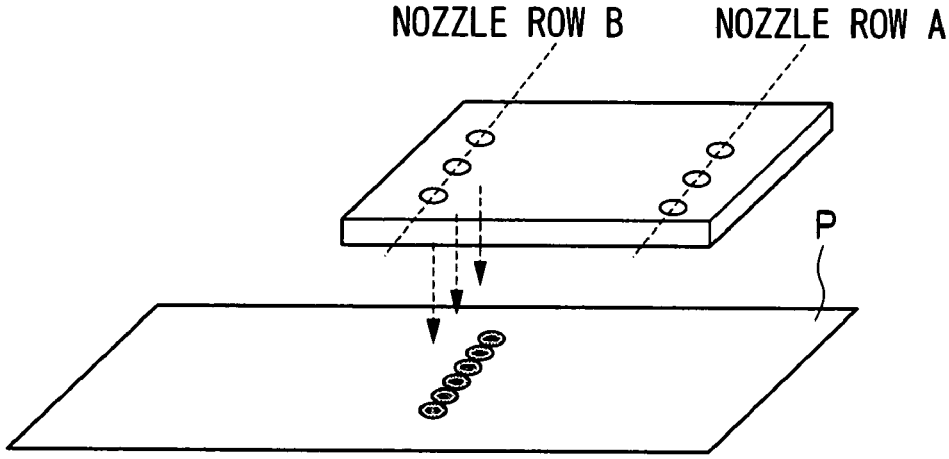

With two-dimensionally arranged nozzles, as shown in FIG. 8A and FIG. 8B, when printing a straight line, a straight line is formed as a result of dots ejected from different nozzle rows A and B interconnecting.

First, part of the straight line is recorded by ink droplets ejected from the nozzle row A (see FIG. 8A), and after a clock calculated from the moving speed of the recording medium P and the distance between the nozzle rows A and B, a straight line is recorded by ink droplets ejected from the nozzle row B (see FIG. 8B).

Figure 9A:
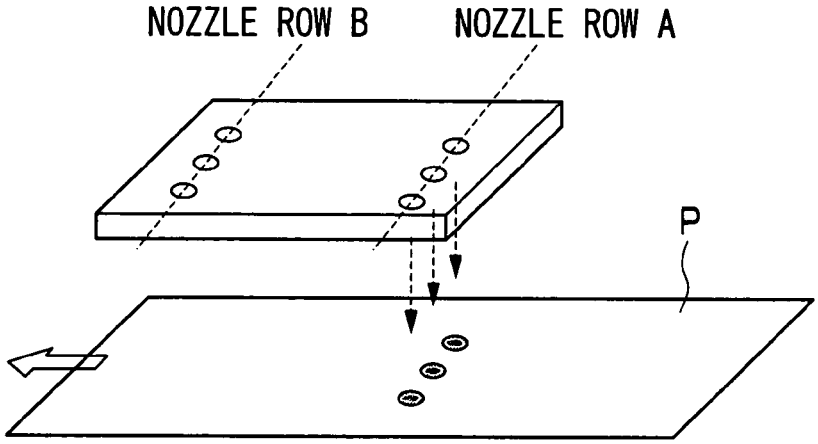
FIGS. 9A and 9B are diagrams showing an instance where the moving speed of a recording medium varies when straight lines are recorded by two-dimensionally arranged nozzles.
Figure 9B:
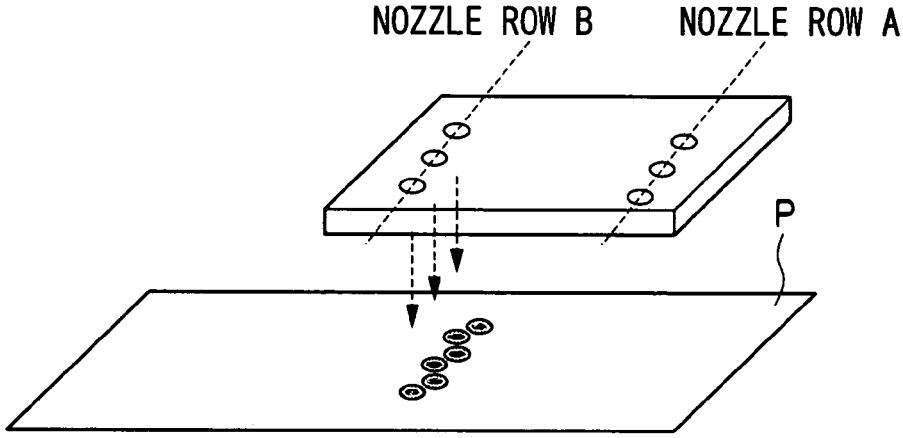

Incidentally, when the moving speed of the recording medium P varies such that the relationship between the clock time and the moving distance of the recording medium P shifts, the landing positions of the ink droplets on the recording medium P shift and the line curves (see FIG. 9A and FIG. 9B). There is a tendency for the shift in the landing positions to become greater the wider the distance is between the nozzle rows A and B.

As another cause of line curvature, it is also conceivable that there may be variations in the attachment precision of each unit configuring the inkjet recording head, but in actuality the static attachment manufacturing precision is sufficiently high, and the affect on line curvature is greater when there are variations in the moving speed of the recording medium P. The manufacturing precision of attachment falls within about ±10 μm, but line curvature resulting from variations in the moving speed of the recording medium P becomes about ±50 μm.

Configuration of the Inkjet Recording Heads 20y to 20k Pertaining to the Present Exemplary Embodiment Next, the configuration of the inkjet recording heads 20Y to 20K pertaining to the present exemplary embodiment will be described.

As shown in FIG. 10A, the inkjet recording heads 20Y to 20K pertaining to the present exemplary embodiment are configured by the inkjet recording head 20K serving as a first liquid droplet ejecting head that is formed by joining together plural units at which nozzles that eject liquid droplets are two-dimensionally arranged and by the inkjet recording heads 20Y, 20M and 20C (indicated as "20Y to 20C" below) serving as second liquid droplet ejecting heads that are formed by joining together plural units at which nozzles that eject liquid droplets are two-dimensionally arranged, with the overlap width of the nozzles between units at joined portions of the units being greater in the second liquid droplet ejecting heads than in the first liquid droplet ejecting head.

The inkjet recording head 20K is an inkjet recording head that ejects black ink and is formed by joining together plural units 19 where nozzles 34 that eject ink droplets are two-dimensionally arranged.

Figure 11A:
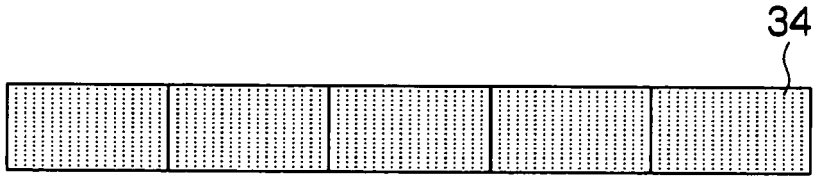
FIG. 11A and FIG. 11B are diagrams showing an inkjet recording head that is formed by joining together units where nozzles are arrayed in a rectangular shape.
Figure 11B:
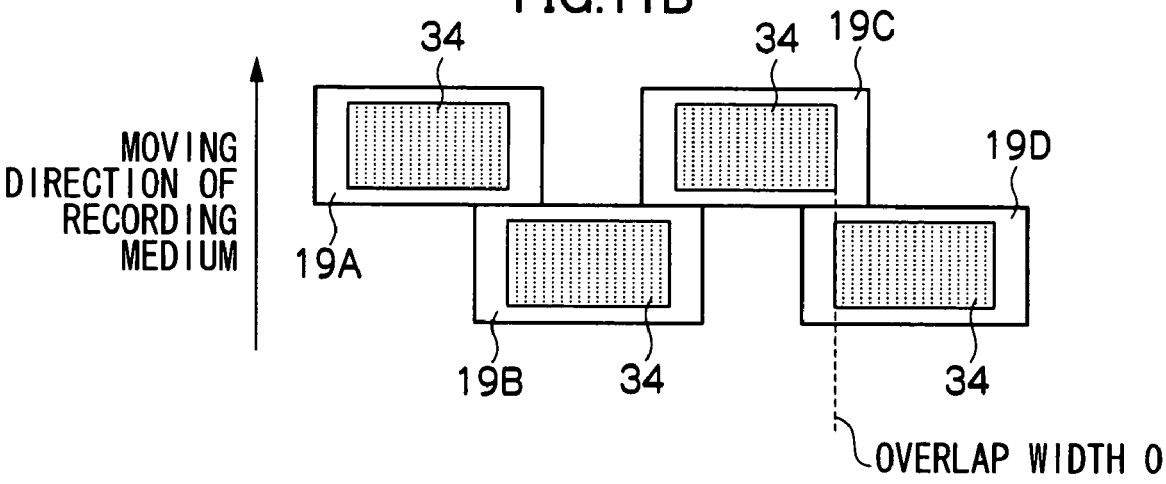

As shown in FIG. 11A, the two-dimensionally arranged plural nozzles 34 are divided into rectangular nozzle arrays—that is, the nozzles 34 are divided such that the outer shape of each of the regions where the nozzles 34 are arrayed is rectangular—and as shown in FIG. 11B, the divided nozzles 34 are distributed in units 19A, 19B, 19C and 19D (indicated as "19A to 19D" below) of the inkjet recording head 20K so that the nozzles 34 in each of the units 19A to 19D are arrayed in a rectangular shape.

In a rectangular nozzle array, as shown in FIG. 11B, the overall shape of the units 19A to 19D is also formed in a rectangular shape.

One side surface of one longitudinal direction (direction orthogonal to the moving direction of the recording medium) end portion (the right end portion in FIG. 11B) of the unit 19A (the lower side surface in FIG. 11B) is joined together with one side surface of one longitudinal direction end portion (the left end portion in FIG. 11B) of the unit 19B (the upper side surface in FIG. 11B) adjacent to the unit 19A. One side surface of the other longitudinal direction end portion (the right end portion in FIG. 11B) of the unit 19B (the upper side surface in FIG. 11B) is joined together with one side surface of one longitudinal direction end portion (the left end portion in FIG. 11B) of the unit 19C (the lower side surface in FIG. 11B) adjacent to the unit 19B. One side surface of the other longitudinal direction end portion (the right end portion in FIG. 11B) of the unit 19C (the lower side surface in FIG. 11B) is joined together with one side surface of one longitudinal direction end portion (the left end portion in FIG. 11B) of the unit 19D (the upper side surface in FIG. 11B) adjacent to the unit 19C.

In this manner, the units 19A to 19D are alternately joined together in order and arranged in a staggered manner, whereby the inkjet recording head 20K is formed.

The inkjet recording head 20K is configured such that the overlap width of the regions where the nozzles 34 are arrayed between the units 19A to 19D at the joined portions of the units 19 is zero. It will be noted that it suffices as long as the outer shape of each of the regions where the nozzles 34 are arrayed in each of the units 19A to 19D of the inkjet recording head 20K is generally rectangular, and it is not necessary for the outer shape to be strictly rectangular. For example, the outer shape may also be one whose corner portions have been cut out or rounded.

The inkjet recording heads 20Y to 20C are inkjet recording heads that respectively eject yellow, magenta and cyan inks, and are formed by joining together plural units 19 where nozzles 34 that eject ink droplets are two-dimensionally arranged.

Figure 12A:
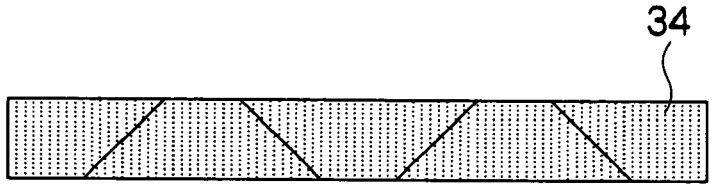
FIG. 12A and FIG. 12B are diagrams showing an inkjet recording head that is formed by joining together units where nozzles are arrayed in a trapezoidal shape.
Figure 12B:
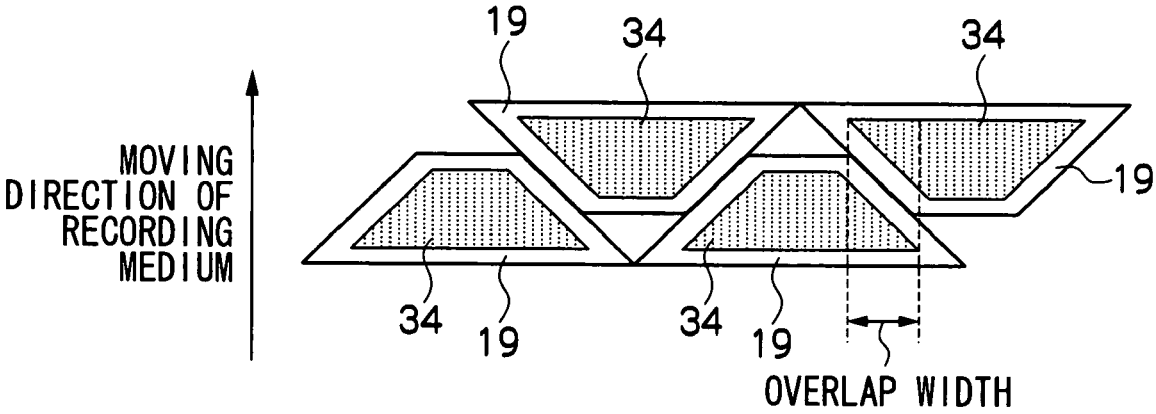

As shown in FIG. 12A, the two-dimensionally arranged plural nozzles 34 are divided into trapezoidal nozzle arrays—that is, the nozzles 34 are divided such that the outer shape of each of the regions where the nozzles 34 are arrayed is trapezoidal—and as shown in FIG. 12B, the divided nozzles 34 are distributed in each of the units 19 of the inkjet recording heads 20Y to 20C, so that the nozzles 34 in each of the units 19 are arrayed in a trapezoidal shape.

In a trapezoidal nozzle array, as shown in FIG. 12B, the overall shape of the units 19 is also formed in a trapezoidal shape and the units 19 are arranged such that their oblique sides face each other, whereby the inkjet recording heads 20Y to 20C are formed.

The inkjet recording heads 20Y to 20C are formed such that part of the regions where the nozzles 34 are arrayed overlap between the units 19 in the relative moving direction of the recording medium and the inkjet recording heads 20Y to 20C. The overlap width of the nozzles 34 between the units 19 at the joined portions of the units 19 of the inkjet recording heads 20Y to 20C is greater than in the inkjet recording head 20K.

It will be noted that the shape of the nozzles arrayed in the trapezoidal shape does not have to be bilaterally symmetrical; the nozzles may be in an array where the angle of each oblique side with respect to the upper base and the lower base are different. It suffices as long as the outer shape of each of the regions where the nozzles 34 are arrayed in each of the units 19 of the inkjet recording heads 20Y to 20C is generally trapezoidal, and it is not necessary for the outer shape to be strictly trapezoidal. For example, the outer shape may also be one whose corner portions have been cut out or rounded.

As shown in FIG. 10B, the inkjet recording heads 20Y to 20K are connected to the head controller 46. The head controller 46 determines the ejection timing of the ink droplets in accordance with image data inputted from the outside and the nozzles 34 of the inkjet recording heads 20Y to 20K to be used, and applies drive signals to those nozzles 34.

Examples of the image data inputted from the outside include image data that an operator of the inkjet recording apparatus 10 creates and inputs with a computer or the like and image data read by an image reading apparatus from a document.

Figure 13A:
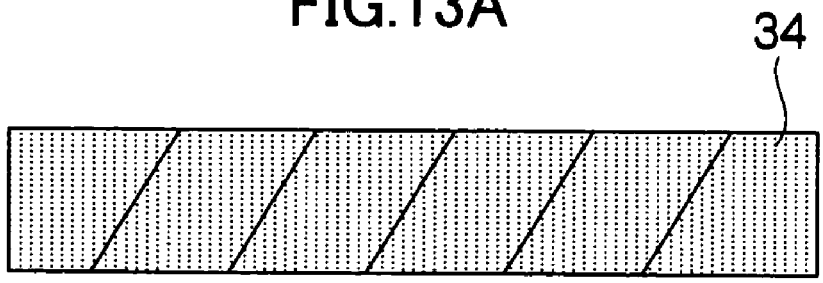
FIG. 13A and FIG. 13B are diagrams showing an inkjet recording head that is formed by joining together units where nozzles are arrayed in a parallelogram shape.
Figure 13B:
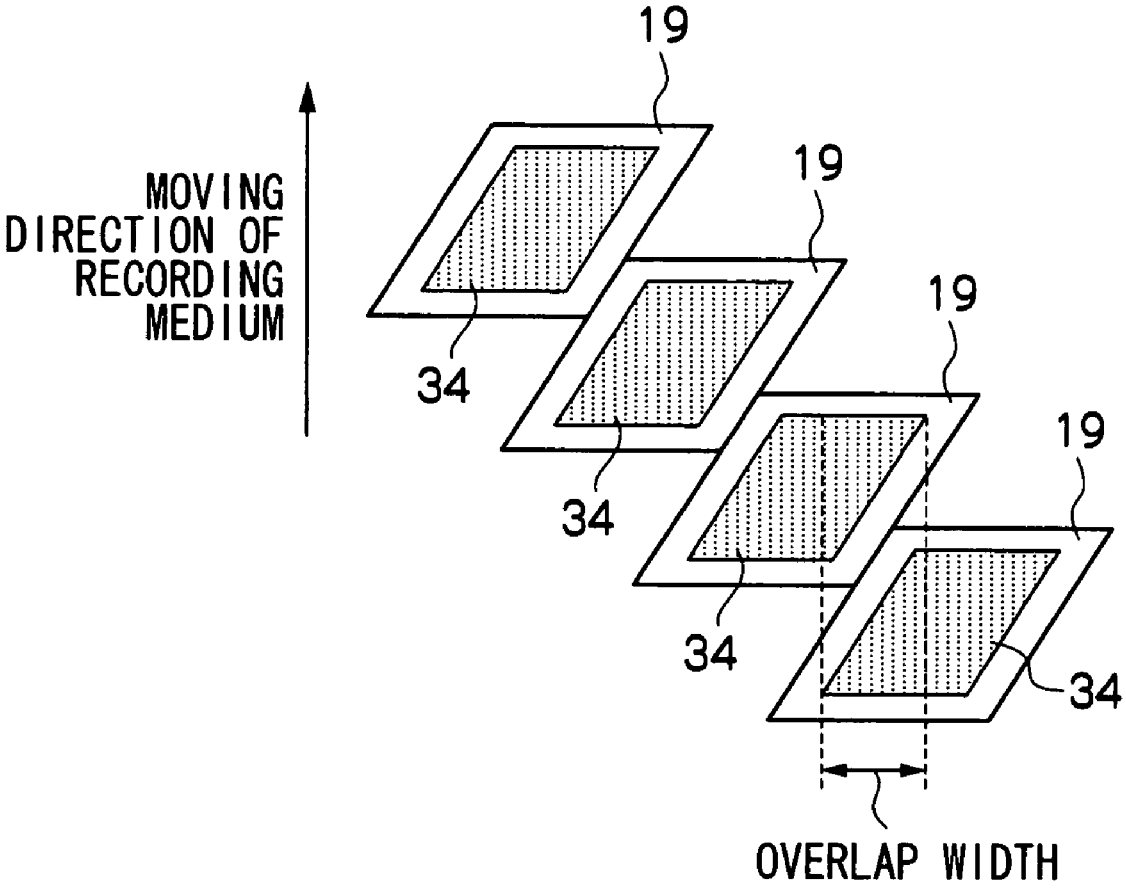

As the nozzle array of the nozzles 34, for example, as shown in FIG. 13A, a nozzle array where the nozzles 34 are divided into parallelogram shapes may also be used. In a parallelogram-shaped nozzle array, as shown in FIG. 13B, the units 19 are arrayed diagonally, whereby an inkjet recording head is formed. According to this configuration, the nozzles 34 between the units 19 are made to overlap at the joined portions of the units 19.

Figure 14:
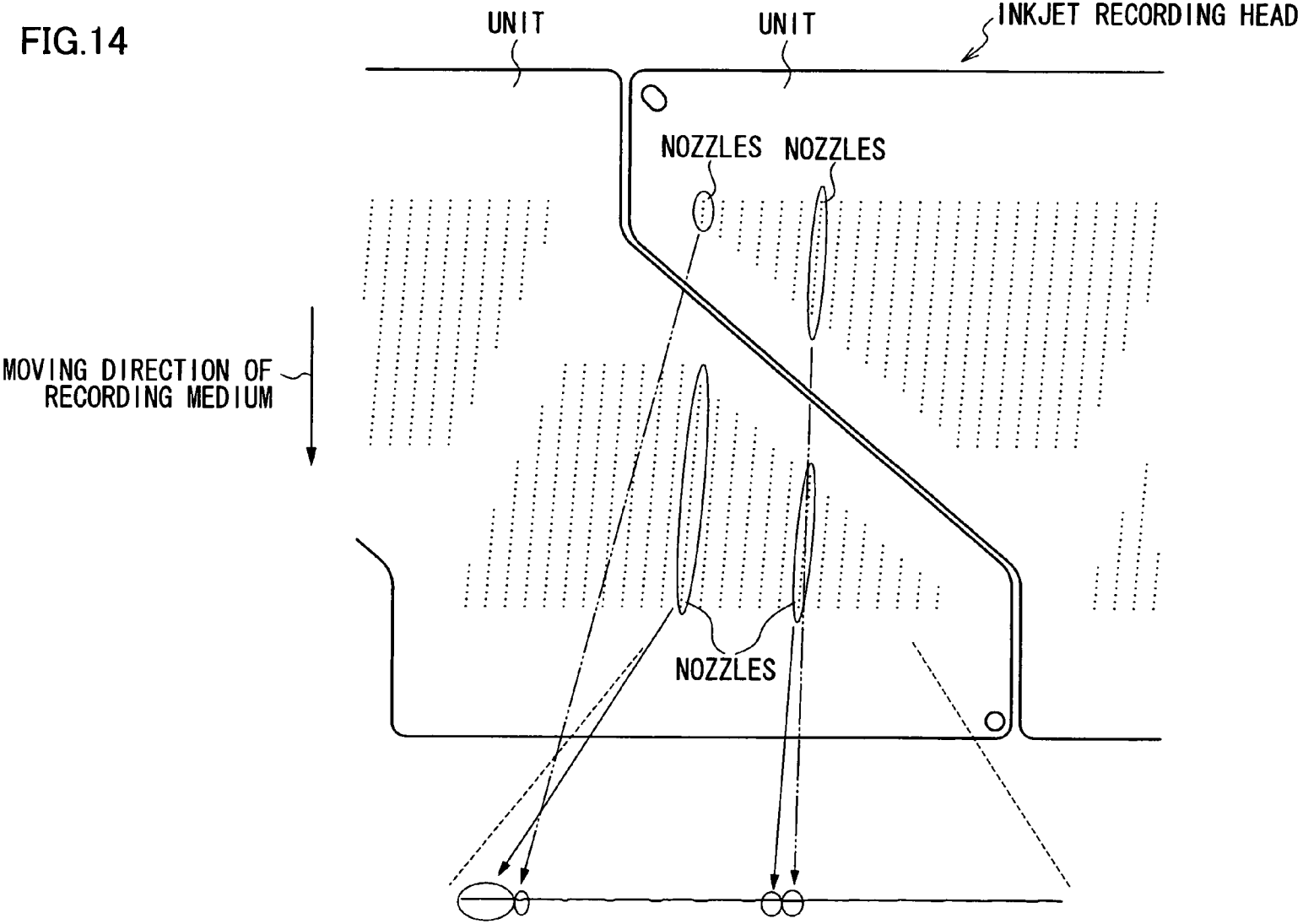
FIG. 14 is a diagram for describing the concept of overlap.
Figure 15:
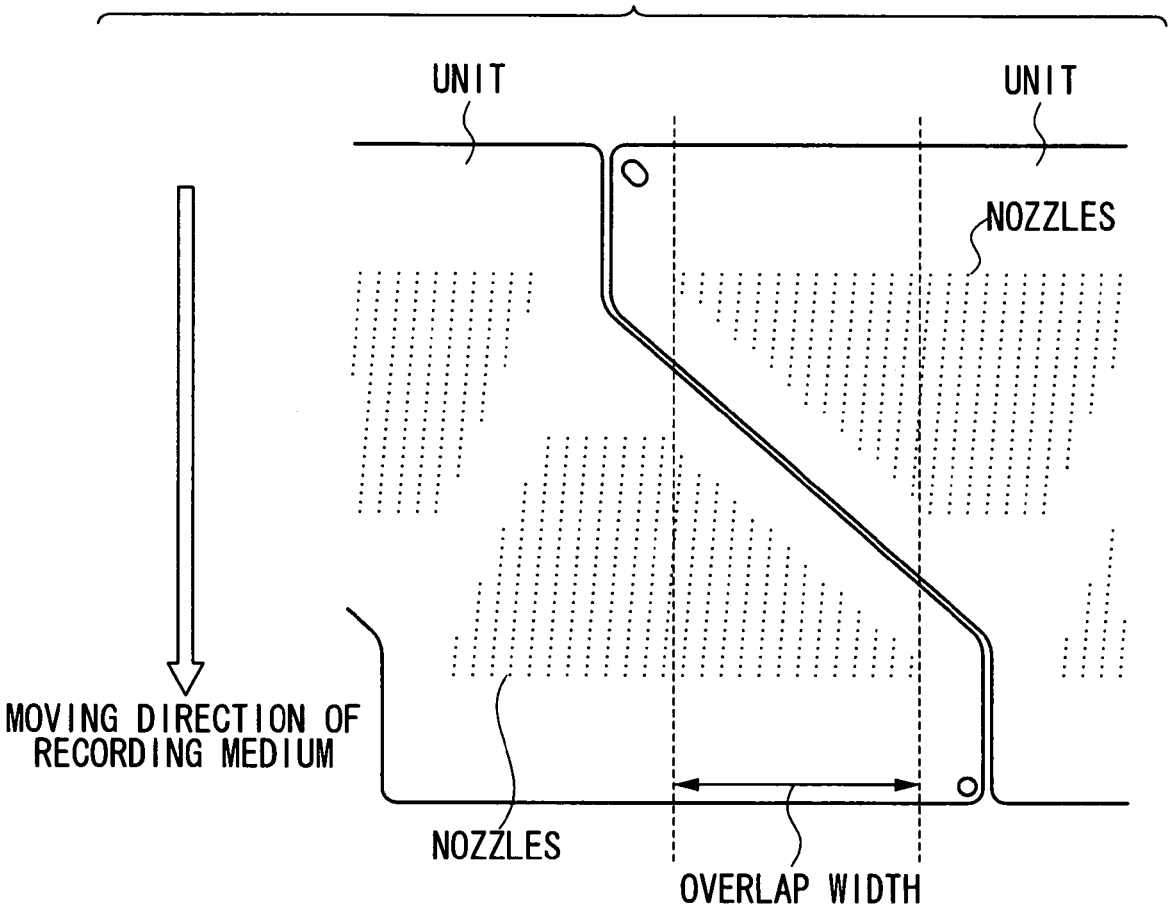
FIG. 15 is a diagram for describing the concept of overlap width.

Further, as shown in FIG. 14, "overlap" refers to forming, at the joined portions of units configuring an inkjet recording head, regions where nozzles belonging to different units share the work of recording an image, and "overlap width" refers to the length of that region (see FIG. 15). That length is the length of the overlapping region in a direction (called F"width direction" below) orthogonal to the relative moving direction of the recording medium and the inkjet recording heads. Further, overlap width is a concept that also includes zero.

As shown in FIG. 15, "overlap width" typically is the width direction length of the corresponding overlapping region when the nozzle-arranged regions of different units overlap in the relative moving direction of the recording medium and the inkjet recording heads.

Figure 16:
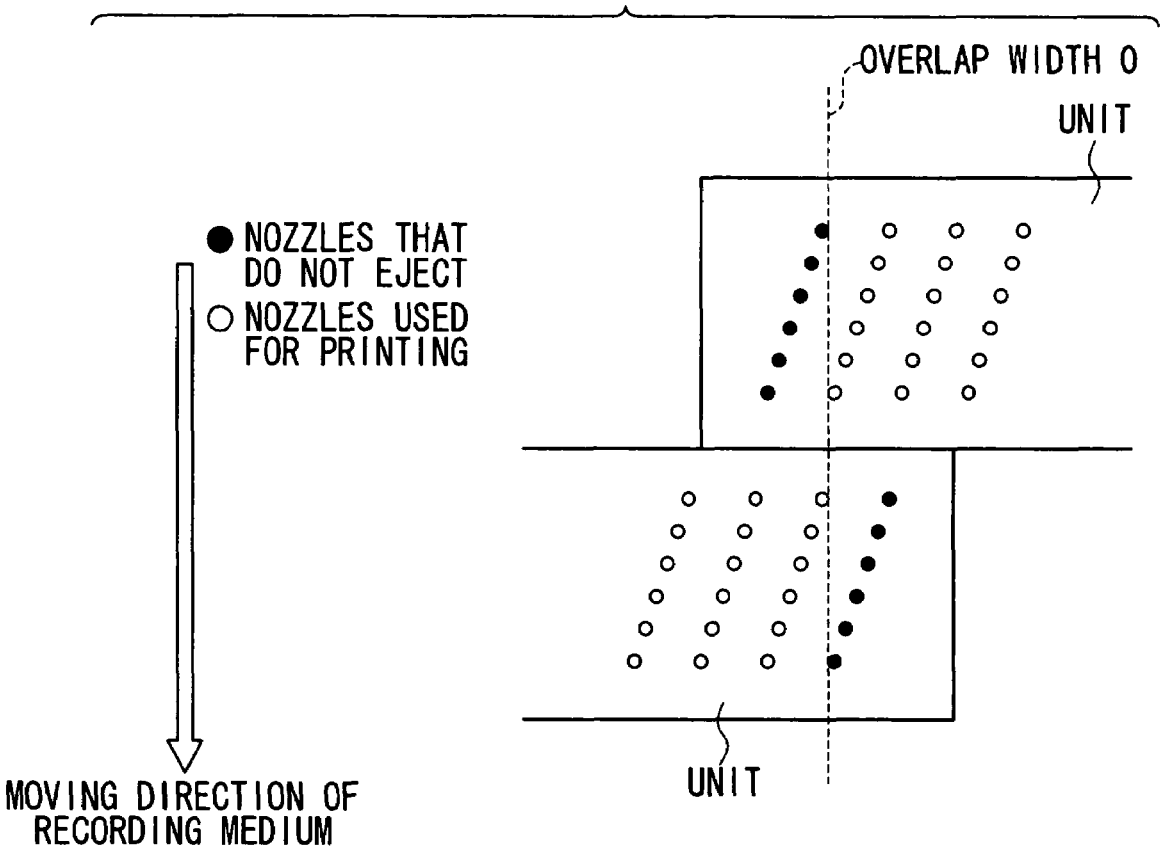
FIG. 16 is a diagram for describing the concept of overlap width.
Figure 17:
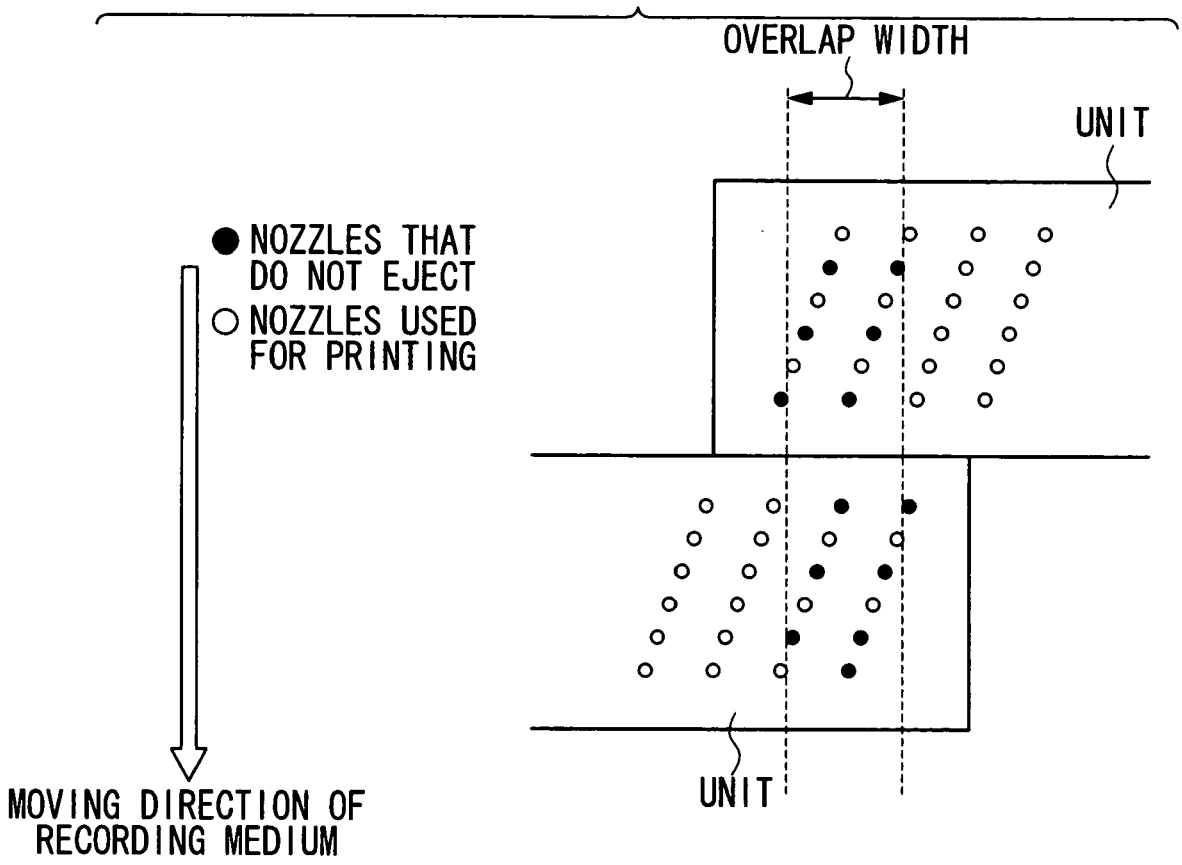
FIG. 17 is a diagram for describing the concept of overlap width.

However, this is not invariably determined by the physical nozzle arrangement. For example, even when units having rectangular nozzle-arranged regions are joined together such that the nozzle-arranged regions overlap in the width direction, as shown in FIG. 16 and FIG. 17, when there are nozzles that do not eject ink droplets, then those nozzles are not included. In the example shown in FIG. 16, the overlap width is zero.

Action of the Present Exemplary Embodiment

Next, the action of the above-described exemplary embodiment will be described.

When image data are inputted from the outside, the head controller 46 determines the nozzles 34 of the inkjet recording heads 20Y to 20K to be used and applies drive signals to those nozzles 34.

Ink droplets are ejected from the nozzles 34 of the inkjet recording heads 20Y to 20K to which the drive signals have been applied, and an image is formed on the recording medium P.

Black ink is ejected from the inkjet recording head 20K, and black ink is often used when recording line images and character images. On the other hand, yellow, magenta and cyan inks are ejected respectively ejected from the inkjet recording heads 20Y to 20C, and yellow, magenta and cyan inks are often used when recording a picture image.

Figure 18:
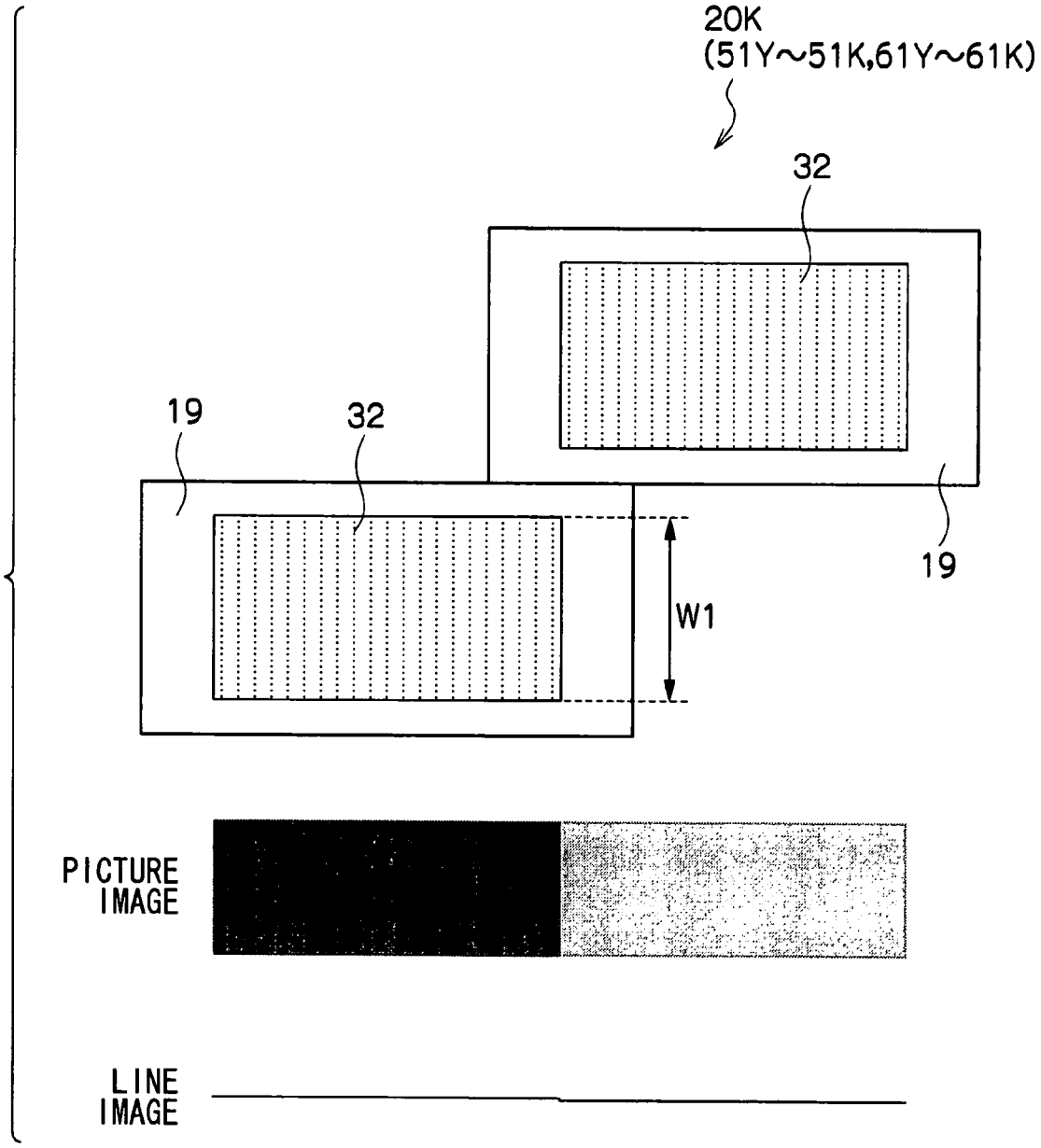
FIG. 18 is a diagram showing a line image and a picture image formed by the inkjet recording head that is formed by joining together units where nozzles are arrayed in a rectangular shape.

In a picture image having a surface region where density fluctuation becomes a problem, on an image formed by the inkjet recording head 20K where the nozzles 34 are arrayed in rectangular shapes, as shown in FIG. 18, density differences are apparent in an area in the image corresponding to the joint lines between the units.

In contrast, in a line image having a length where line curvature becomes a problem, there is low frequency line curvature where there is one joint portion, and it is difficult for line curvature to be seen (see FIG. 5 and FIG. 6).

Further, because a distance W1 between the nozzle rows in the units 19 of the inkjet recording head 20K is smaller than a distance W2 (see FIG. 19) between the nozzle rows of the overlapping regions of the inkjet recording heads 20Y to 20C, the amplitude of line curvature generated in the line image is small, and it is difficult for line curvature to be seen (see FIG. 5 and FIG. 6).

Figure 19:
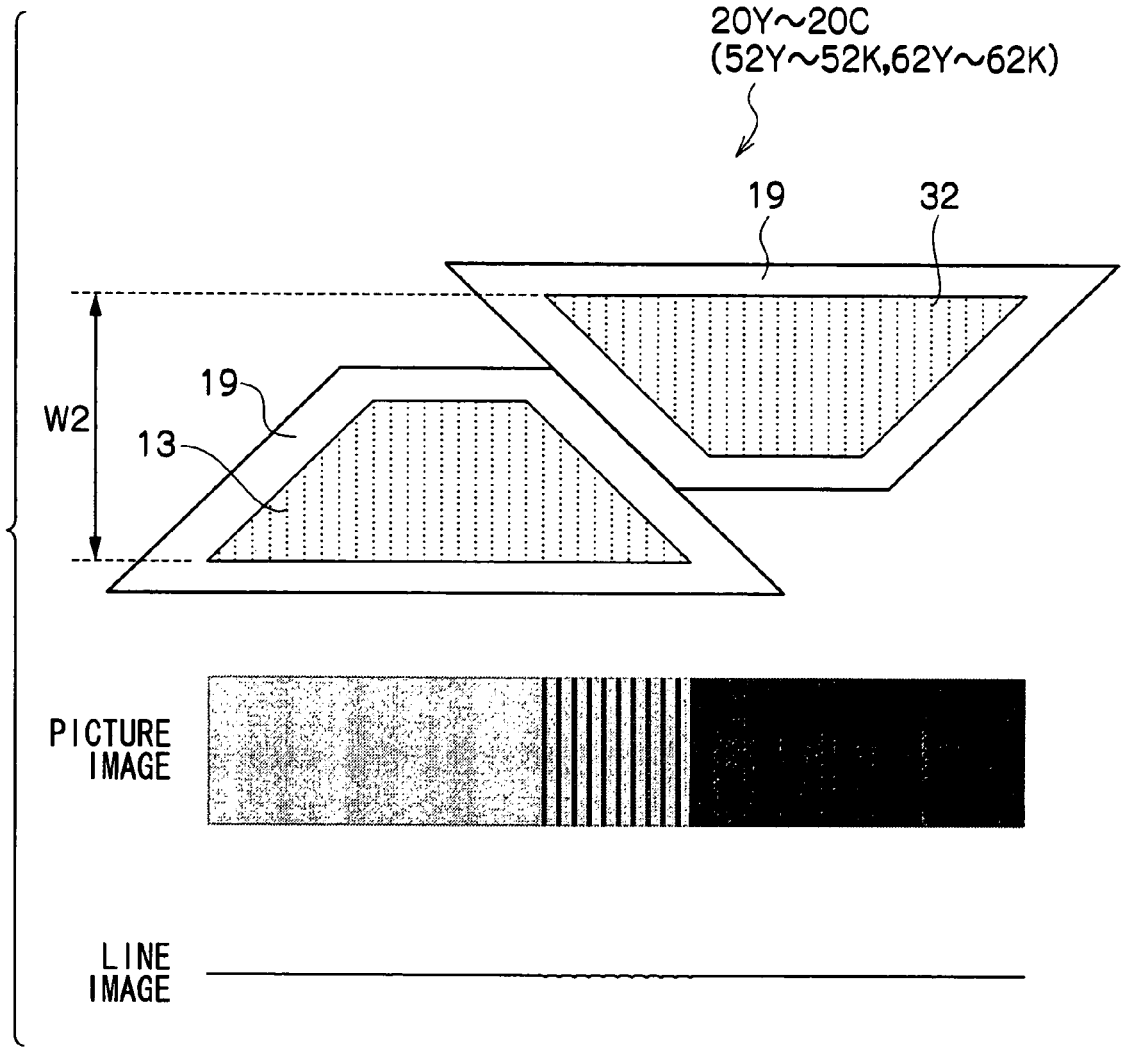
FIG. 19 is a diagram showing a line image and a picture image formed by the inkjet recording head that is formed by joining together units where nozzles are arrayed in a trapezoidal shape.

On the other hand, in an image formed by the inkjet recording heads 20Y to 20C where the nozzles 34 are arrayed in trapezoidal shapes, as shown in FIG. 19, the frequency of density fluctuation becomes higher in a picture image having a surface region where density fluctuation becomes a problem—that is, the density changes gradually—so it is difficult for density differences to be conspicuous (see FIG. 3).

In contrast, in a line image having a length where line curvature becomes a problem, the distance W2 between the nozzle rows of the overlapping regions of the inkjet recording heads 20Y to 20C is greater than the distance W1 between the nozzle rows in the units 19 of the inkjet recording head 20K, so the amplitude of line curvature formed in the line image is large, the frequency is also at a region where visibility is high, and line curvature is conspicuous (see FIG. 5 and FIG. 6).

In the inkjet recording apparatus 10 pertaining to the exemplary embodiment, given that the inkjet recording head 20K that ejects black ink is often used when recording line images and character images and that the inkjet recording heads 20Y to 20C that eject yellow, magenta and cyan inks are often used when recording picture images, an inkjet recording head suited for recording line images and character images—that is, an inkjet recording head where the overlap width is zero—is used for the inkjet recording head 20K, and inkjet recording heads suited for recording picture images—that is, inkjet recording heads where the overlap width is greater than in the inkjet recording head 20K—are used for the inkjet recording heads 20Y to 20C.

It will be noted that the overlap width in the inkjet recording head 20K pertaining to the present exemplary embodiment is zero, but it is possible if the regions where the nozzles are arrayed overlap; it suffices as long as the overlap width is smaller in the inkjet recording head 20K than in the inkjet recording heads 20Y to 20C.

(First Modification of the Inkjet Recording Apparatus 10)

Next, a first modification of the inkjet recording apparatus 10 will be described.

The inkjet recording apparatus 10 pertaining to the above-described exemplary embodiment is provided with one inkjet recording head for each color, but in an inkjet recording apparatus 50 pertaining to the first modification, two inkjet recording heads are provided for each color. The configuration other than that of the inkjet recording heads is the same as that of the inkjet recording apparatus 10 pertaining to the above-described exemplary embodiment.

Figure 20:
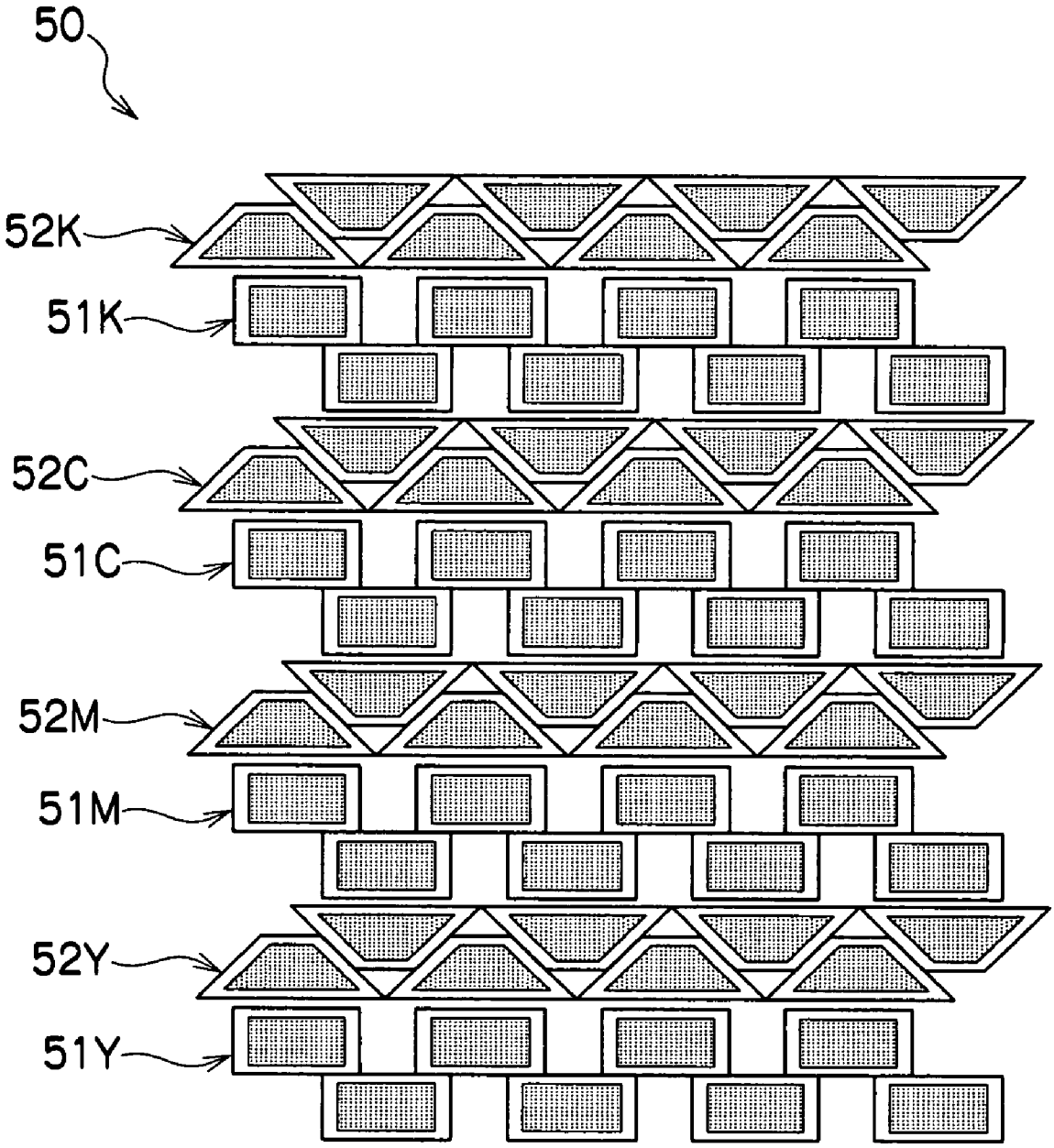
FIG. 20 is a diagram showing the configuration of inkjet recording heads pertaining to a first modification.

As shown in FIG. 20, the inkjet recording apparatus 50 pertaining to the first modification is disposed with inkjet recording heads 51Y, 51M, 51C and 51K (indicated as "51Y to 51K" below) serving as a first liquid droplet ejecting heads that are formed by joining together plural units at which nozzles that eject liquid droplets are two-dimensionally arranged and inkjet recording heads 52Y, 52M, 52C and 52K (indicated as "52Y to 52K" below) serving as second liquid droplet ejecting heads that are formed by joining together plural units at which nozzles that eject liquid droplets are two-dimensionally arranged, with the overlap width of the nozzles between units at joined portions of the units being greater in the second liquid droplet ejecting heads than in the first liquid droplet ejecting heads.

In this manner, the first liquid droplet ejecting heads are not limited to inkjet recording heads that eject black ink and can also be used as inkjet recording heads that eject yellow, magenta and cyan inks. The second liquid droplet ejecting heads are not limited to inkjet recording heads that eject yellow, magenta and cyan inks and can also be used as inkjet recording heads that eject black ink.

The inkjet recording heads 51Y to 51K have the same configuration as that of the aforementioned inkjet recording head 20K, and the inkjet recording heads 52Y to 52K have the same configuration as that of the aforementioned inkjet recording heads 20Y to 20C.

It will be noted that the inkjet recording heads 51Y and 52Y, the inkjet recording heads 51M and 52M, the inkjet recording heads 51C and 52C, and the inkjet recording heads 51K and 52K are configured to respectively eject inks whose color hues are the same.

Figure 21A:
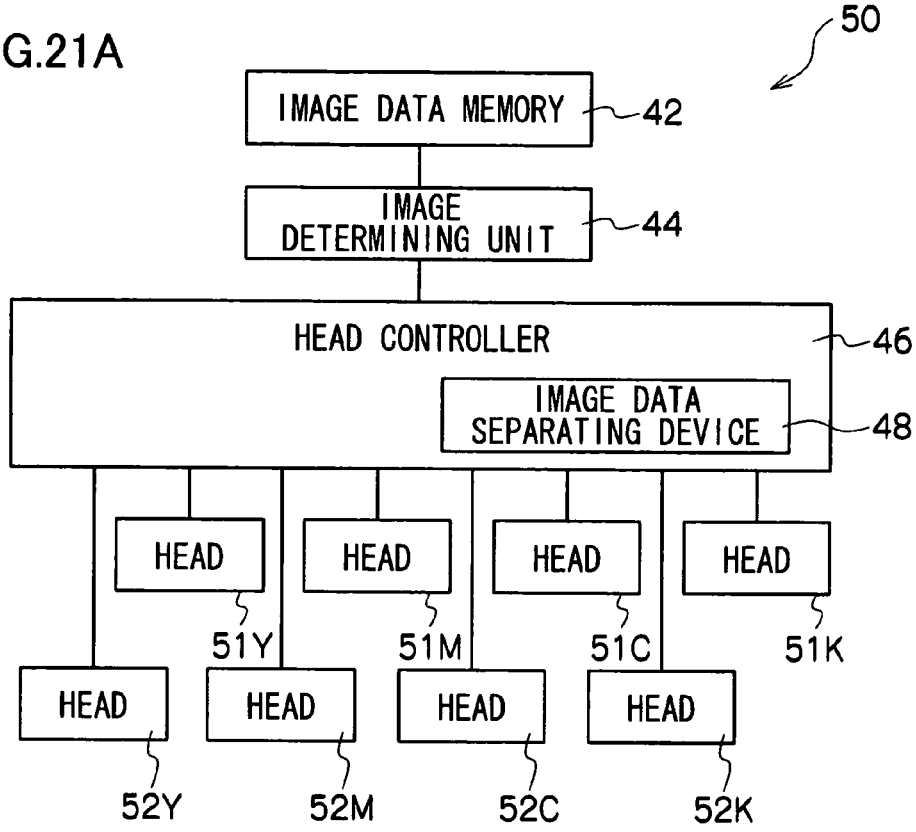
FIG. 21A and FIG. 21B are block diagrams showing control systems that control operation of the inkjet recording heads pertaining to the first modification, with FIG. 21A showing a configuration disposed with an image data separating device and FIG. 21B showing a configuration disposed with an image data extracting device instead of the image data separating device.

As shown in FIG. 21A, the inkjet recording apparatus 50 is also disposed with an image data memory 42 that stores image data inputted from the outside. Examples of the image data inputted from the outside include image data that an operator of the inkjet recording apparatus 50 creates and inputs with a computer or the like and image data read by an image reading apparatus from a document.

An image determining unit 44 is connected to the image data memory 42. The image determining unit 44 determines whether or not the image data that the image data memory 42 is to store are line image data and character image data or picture image data.

The image determining unit 44 recognizes and determines as picture image data an image having a surface region where density fluctuation becomes a problem and recognizes and determines as line image data an image having a length where line curvature becomes a problem.

For example, the image determining unit 44 determines whether image data resulting from electronic data created by a computer or the like are line image data and character image data or picture image data by header information attached to the image data.

When the image data do not have a header, such as image data read by an image reading apparatus, then the image determining unit 44 determines whether the image data are line image data and character image data or picture image data by determining whether or not the tone difference (differential value or frequency) with neighboring pixels exceeds a threshold.

The image determining unit 44 may also determine whether image data that do not have a header are line image data, character image data and picture image data by pattern matching. As the pattern matching, an m×n region around a target pixel is extracted and compared with comparison pattern data of line image data and character image data in a memory, and when the data match, then the data are processed as line image data and character image data, and when the data do not match, then the data are processed as picture image data.

Regardless of whether or not header information has been attached, it suffices as long as the image determining unit 44 performs determination by whether or not the tone difference (differential value or frequency) with neighboring pixels exceeds a threshold and determination by pattern matching of line image data, character image data and picture image data.

Further, the head controller 46 serving as a control unit is connected to the image determining unit 44, and an image data separating device 48 serving as an image data separating unit that separates inputted image data into line image data and character image data or into picture image data is disposed in the head controller 46.

The image data separating device 48 is configured to separate the image data that the image determining unit 44 has determined into line image data and character image data or into picture image data.

The head controller 46 applies drive signals to the inkjet recording heads 51Y to 51K to cause the inkjet recording heads 51Y to 51K to eject ink droplets on the basis of the line image data and character image data that the image data separating device 48 has separated. The head controller 46 also applies drive signals to the inkjet recording heads 52Y to 52K to cause the inkjet recording heads 52Y to 52K to eject ink droplets on the basis of the picture image data that the image data separating device 48 has separated.

(Action of the First Modification)

Next, the action of the above-described first modification will be described.

When image data are inputted from the outside, the image data are stored by the image data memory 42. The image determining unit 44 determines whether the image data are line image data and character image data or picture image data.

The image data separating device 48 separates the image data determined by the image determining unit 44 into line image data and character image data or into picture image data.

The head controller 46 applies drive signals to the inkjet recording heads 51Y to 51K to cause the inkjet recording heads 51Y to 51K to eject ink droplets on the basis of the line image data and character image data that the image data separating device 48 has separated. The head controller 46 also applies drive signals to the inkjet recording heads 52Y to 52K to cause the inkjet recording heads 52Y to 52K to eject ink droplets on the basis of the picture image data that the image data separating device 48 has separated. Thus, an image is formed on the recording medium P.

In an image formed by the inkjet recording heads 51Y to 51K where the nozzles are arrayed in rectangular shapes, as shown in FIG. 18, density differences are apparent at a portion corresponding to the joint lines between the units in a picture image having a surface region where density fluctuation becomes a problem.

In contrast, in a line image and character image having a length where line curvature becomes a problem, as shown in FIG. 18, there is low frequency line curvature where there is one joint portion, and it is difficult for line curvature to be seen (see FIG. 5 and FIG. 6).

Further, because the distance W1 between the nozzle rows in the units 19 of the inkjet recording heads 51Y to 51K is smaller than the distance W2 (see FIG. 19) between the nozzle rows of the overlapping regions of the inkjet recording heads 52Y to 52K, the amplitude of line curvature formed in the line image is small, and it is difficult for line curvature to be seen (see FIG. 5 and FIG. 6).

On the other hand, in an image formed by the inkjet recording heads 52Y to 52K where the nozzles are arrayed in trapezoidal shapes, as shown in FIG. 19, the frequency of density fluctuation becomes higher in a picture image having a surface region where density fluctuation becomes a problem—that is, the density changes gradually—so it is difficult for density differences to be conspicuous (see FIG. 3).

In contrast, in a line image having a length where line curvature becomes a problem, because the distance W2 between the nozzle rows of the overlapping regions of the inkjet recording heads 52Y to 52K is greater than the distance W1 between the nozzle rows of the units 19 of the inkjet recording heads 51Y to 51K, the amplitude of line curvature formed in the line image is large, the frequency is also in a region where visibility is high, and line curvature is conspicuous (see FIG. 5 and FIG. 6).

In the inkjet recording apparatus 10 pertaining to the above-described exemplary embodiment, given that the inkjet recording head 20K that ejects black ink is often used when recording line images and character images and that the inkjet recording heads 20Y to 20C that eject yellow, magenta and cyan inks are often used when recording picture images, an inkjet recording head suited for recording line images and character images is used for the inkjet recording head 20K, and inkjet recording heads suited for recording picture images are used for the inkjet recording heads 20Y to 20C.

In contrast, in the first modification, as described above, line images and character images, or picture images are separated, inkjet recording heads suited for line images and character images—that is, the inkjet recording heads 51Y to 51K where the overlap width is zero—are used for line images and character images to record an image, and inkjet recording heads suited for picture images—that is, inkjet recording heads where the overlap width is greater than in the inkjet recording heads 51Y to 51K—are used for picture images to record an image.

Figure 21B:
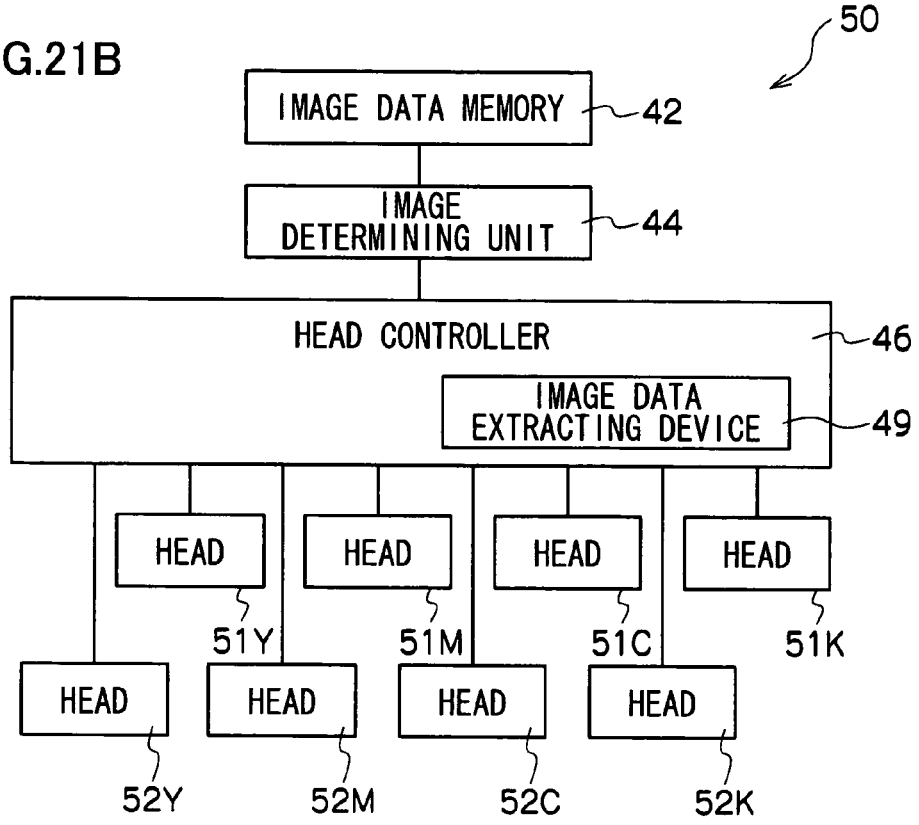

It will be noted that, as shown in FIG. 21B, instead of the image data separating device 48, an image data extracting device 49 serving as an image data extracting unit that extracts line image data and character image data from inputted image data may be disposed in the head controller 46.

In this configuration, the image data extracting device 49 is configured to extract line image data and character image data from the image data that the image determining unit 44 has determined.

The head controller 46 applies drive signals to the inkjet recording heads 51Y to 51K to cause the inkjet recording heads 51Y to 51K to eject ink droplets on the basis of the line image data and character image data that the image data extracting device 44 has extracted. The head controller 46 also applies drive signals to the inkjet recording heads 52Y to 52K to cause the inkjet recording heads 52Y to 52K to eject ink droplets on the basis of the picture image data that the image data extracting device 49 has not extracted.

The image data extracting device 49 may also be used as image data extracting unit that extracts picture image data from inputted image data.

In this configuration, the image data extracting device 49 is configured to extract picture image data from the image data that the image determining unit 44 has determined.

The head controller 46 applies drive signals to the inkjet recording heads 52Y to 52K to cause the inkjet recording heads 52Y to 52K to eject ink droplets on the basis of the picture image data that the image data extracting device 44 has extracted. The head controller 46 also applies drive signals to the inkjet recording heads 51Y to 51K to cause the inkjet recording heads 51Y to 51K to eject ink droplets on the basis of the line image data and character image data that the image data extracting device 49 has not extracted.

(Second Modification of the Inkjet Recording Apparatus 10)

Next, a second modification of the inkjet recording apparatus 10 will be described.

The inkjet recording apparatus 10 pertaining to the above-described exemplary embodiment is provided with one inkjet recording head for each color, but in an inkjet recording apparatus 60 pertaining to the second modification, similar to the first modification, two inkjet recording heads are provided for each color. The configuration other than that of the inkjet recording heads is the same as that of the inkjet recording apparatus 10 pertaining to the above-described exemplary embodiment.

Figure 22:
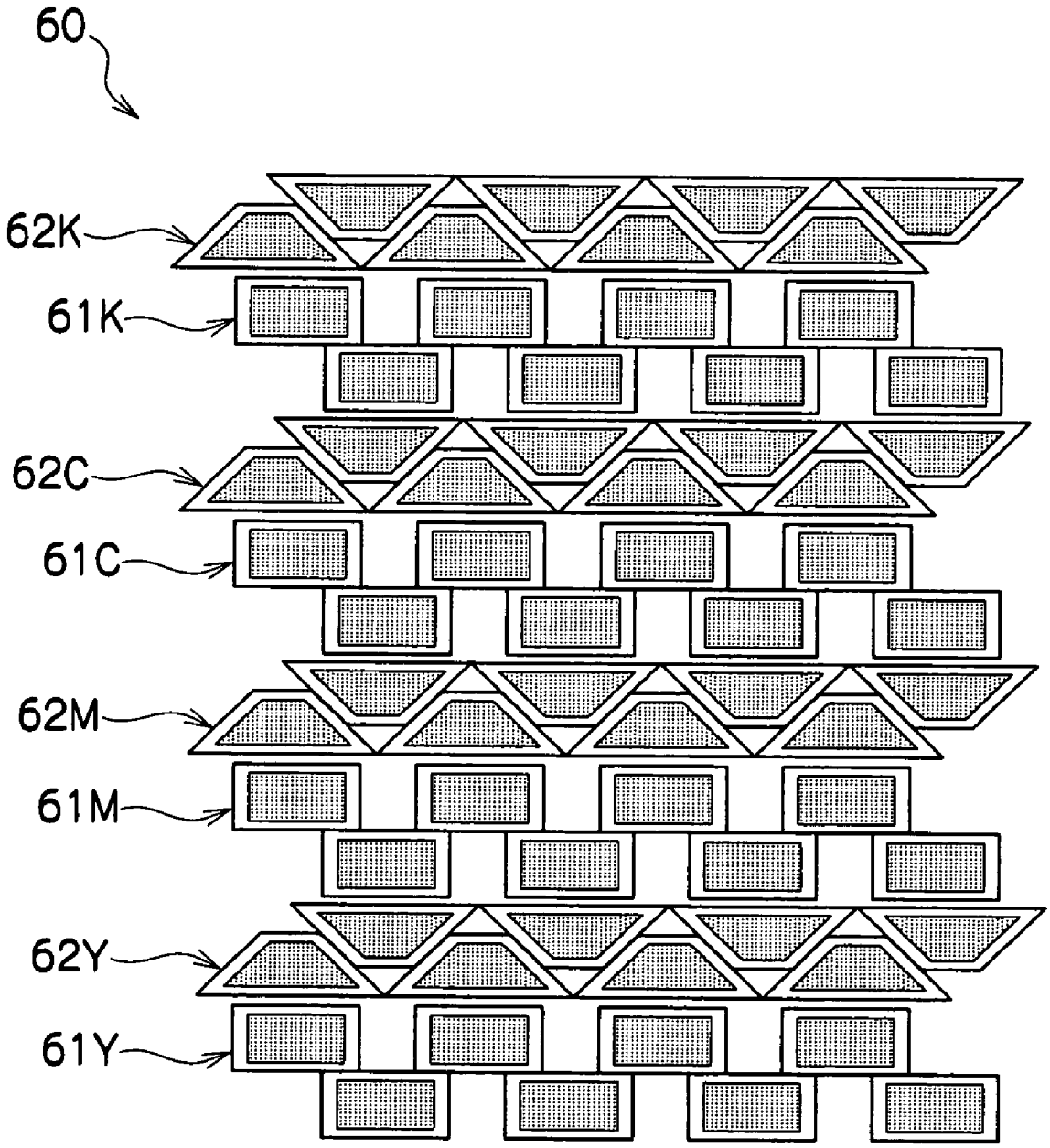
FIG. 22 is a diagram showing the configuration of inkjet recording heads pertaining to a second modification.

As shown in FIG. 22, the inkjet recording apparatus 60 pertaining to the second modification is disposed with inkjet recording heads 61Y, 61M, 61C and 61K (indicated as "61Y to 61K" below) serving as a first liquid droplet ejecting heads that are formed by joining together plural units at which nozzles that eject liquid droplets are two-dimensionally arranged and inkjet recording heads 62Y, 62M, 62C and 62K (indicated as "62Y to 62K" below) serving as second liquid droplet ejecting heads that are formed by joining together plural units at which nozzles that eject liquid droplets are two-dimensionally arranged, with the overlap width of the nozzles between units at joined portions of the units being greater in the second liquid droplet ejecting heads than in the first liquid droplet ejecting heads.

The inkjet recording heads 61Y to 61K have the same configuration as that of the aforementioned inkjet recording head 20K, and the inkjet recording heads 62Y to 62K have the same configuration as that of the aforementioned inkjet recording heads 20Y to 20C.

Further, the inkjet recording heads 61Y to 61K eject dark inks that are darker than those of the inkjet recording heads 62Y to 62K, and the inkjet recording heads 62Y to 62K eject light inks that are lighter than those of the inkjet recording heads 61Y to 61K. It will be noted that the inkjet recording heads 61Y and 62Y, the inkjet recording heads 61M and 62M, the inkjet recording heads 61C and 62C, and the inkjet recording heads 61K and 62K respectively eject inks whose color hues are the same.

Further, the inkjet recording apparatus 60 is disposed with the image data memory 42, the image determining unit 44, the head controller 46 and the image data separating device 48 having the same functions described in the first modification (see FIG. 21A).

It will be noted that, as described in the first modification, the image data extracting device 49 may also be disposed instead of the image data separating device 48 (see FIG. 21B).

(Action of the Second Modification)

Next, the action of the above-described second modification will be described.

When image data are inputted from the outside, the image data are stored in the image data memory 42. The image determining unit 44 determines whether the image data are line image data and character image data or picture image data.

The image data separating device 48 separates the image data determined by the image determining unit 44 into line image data and character image data or into picture image data.

The head controller 46 applies drive signals to the inkjet recording heads 61Y to 61K to cause the inkjet recording heads 61Y to 61K to eject ink droplets on the basis of the line image data and character image data that the image data separating device 48 has separated. The head controller 46 also applies drive signals to the inkjet recording heads 62Y to 62K to cause the inkjet recording heads 62Y to 62K to eject ink droplets on the basis of the picture image data that the image data separating device 48 has separated. Thus, an image is formed on the recording medium P.

In an image formed by the inkjet recording heads 61Y to 61K where the nozzles are arrayed in rectangular shapes, as shown in FIG. 18, in a picture image having a surface region where density fluctuation becomes a problem, density differences are apparent at an area of the image corresponding to the joint lines between the units.

Because the inkjet recording heads 61Y to 61K eject dark inks, in a line image having a length where line curvature becomes a problem, it is easy for line curvature to become conspicuous, but as shown in FIG. 18, there is low frequency line curvature where there is one joint portion, and it is difficult for line curvature to be seen (see FIG. 5 and FIG. 6).

Further, because the distance W1 between the nozzle rows in the units 19 of the inkjet recording heads 61Y to 61K is smaller than the distance W2 between the nozzle rows of the overlapping regions of the inkjet recording heads 62Y to 62K, the amplitude of line curvature formed in the line image is small, and it is difficult for line curvature to be seen (see FIG. 5 and FIG. 6).

In contrast, in an image formed by the inkjet recording heads 62Y to 62K where the nozzles are arrayed in trapezoidal shapes, as shown in FIG. 19, because the distance W2 between the nozzle rows of the overlapping regions of the inkjet recording heads 62Y to 62K is greater than the distance W1 between the nozzle rows in the units 19 of the inkjet recording heads 61Y to 61K, the amplitude of line curvature formed in the line image is large, the frequency is also in a region where visibility is high, and line curvature is conspicuous (see FIG. 5 and FIG. 6).

Further, in an image having a surface area where density fluctuation becomes a problem even with light inks, it is easy for density fluctuation to become conspicuous when the density fluctuation is low frequency, but in an image formed by the inkjet recording heads 62Y to 62K, the frequency of the density fluctuation becomes higher—that is, the density changes gradually—so it is difficult for density differences to be conspicuous.

In the inkjet recording apparatus 10 pertaining to the above-described exemplary embodiment, given that the inkjet recording head 20K that ejects black ink is often used when recording line images and character images and that the inkjet recording heads 20Y to 20C that eject yellow, magenta and cyan inks are often used when recording picture images, an inkjet recording head suited for recording line images and character images is used for the inkjet recording head 20K, and inkjet recording heads suited for recording picture images are used for the inkjet recording heads 20Y to 20C.

In contrast, in the second modification, as described above, line images and character images, or picture images are separated, inkjet recording heads suited for line images and character images—that is, the inkjet recording heads 61Y to 61K where the overlap width is zero—are used for line images and character images to record an image, and inkjet recording heads suited for picture images—that is, inkjet recording heads where the overlap width is greater than in the inkjet recording heads 61Y to 61K—are used for picture images to record an image.

It will be noted that the dark inks are inks that are relatively darker than light inks from the standpoint of optical density and that the light inks are inks that are relatively lighter than dark inks from the standpoint of optical density. Optical density is measured by dots formed on a recording medium or the reflectance (light intensity of reflected light) of a predetermined pattern.

(Comparison of Image Defects with Respect to Noise)

As shown in FIG. 23, image defects with respect to noise are compared in regard to inkjet recording heads where the nozzles are arrayed in rectangular shapes—that is, the inkjet recording head 20K pertaining to the exemplary embodiment, the inkjet recording heads 51Y to 51K pertaining to the first modification, and the inkjet recording heads 61Y to 61K pertaining to the second modification—and in regard to inkjet recording heads where the nozzles are arrayed in trapezoidal shapes—that is, the inkjet recording heads 20Y to 20C pertaining to the exemplary embodiment, the inkjet recording heads 52Y to 52K pertaining to the first modification, and the inkjet recording heads 62Y to 62K pertaining to the second modification.

As noise, instances where there are differences in the droplet quantities of ink droplets between units, instances where the attachment positions are shifted between units, and instances where there are speed variations in the paper serving as the recording medium are compared.

As the inkjet recording apparatus, an apparatus whose resolution is 600 dpi, whose paper conveying speed is 22.5 inches/sec., and where there are 1024 nozzles per unit is used.

As a result, as shown in FIG. 23, it is understood that density fluctuation is stable with respect to noise in the inkjet recording head of the trapezoidal array and that line character images are stable with respect to noise in the inkjet recording head of the rectangular array.

It will be noted that the overlap width is zero in the inkjet recording head 20K pertaining to the exemplary embodiment, the inkjet recording heads 51Y to 51K pertaining to the first modification, and the inkjet recording heads 61Y to 61K pertaining to the second modification, but it is alright if the regions where the nozzles are arrayed overlap; it suffices as long as the overlap width is smaller in these inkjet recording heads than in the inkjet recording heads 20Y to 20C pertaining to the exemplary embodiment, the inkjet recording heads 52Y to 52K pertaining to the first modification, and the inkjet recording heads 62Y to 62K pertaining to the second modification.

Figure 24A:
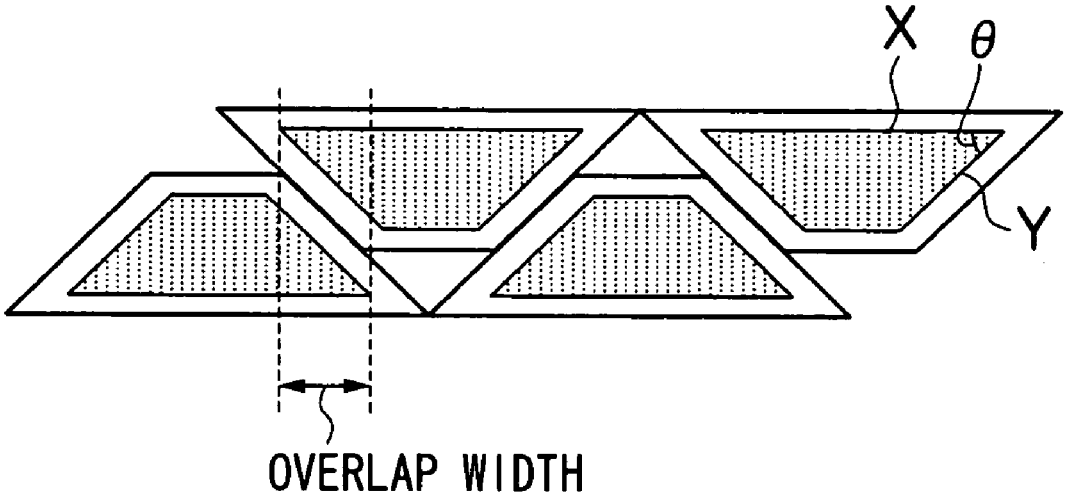
FIG. 24A and FIG. 24B are diagrams showing modifications of an inkjet recording head.
Figure 24B:
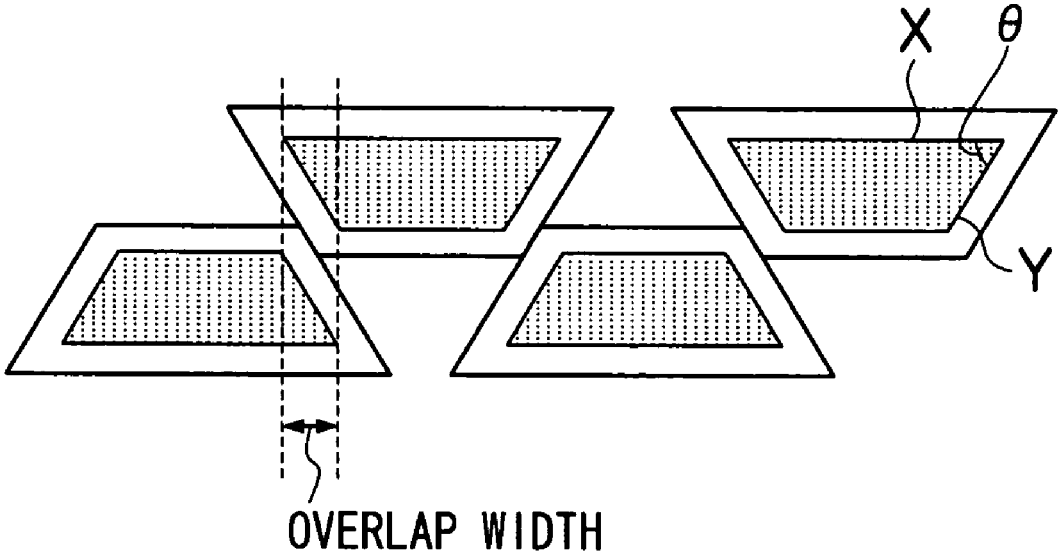

For example, as shown in FIG. 24A and FIG. 24B, inkjet recording heads may be formed by units where the nozzles are arrayed in a trapezoidal shape, and an angle θ of an oblique side Y with respect to a long side X of the upper base and the lower base of the trapezoid may be changed, whereby inkjet recording heads where the overlap width is different can be formed. Consequently, the inkjet recording heads 20Y to 20C pertaining to the exemplary embodiment, the inkjet recording heads 52Y to 52K pertaining to the first modification, and the inkjet recording heads 62Y to 62K pertaining to the second modification may be configured by inkjet recording heads where the angle θ is relatively small (see FIG. 24A), and the inkjet recording head 20K pertaining to the exemplary embodiment, the inkjet recording heads 51Y to 51K pertaining to the first modification, and the inkjet recording heads 61Y to 61K pertaining to the second modification may be configured by inkjet recording heads where the angle θ is relatively large (see FIG. 24B).

Further, the image-recordable width of each of the inkjet recording heads 20Y to 20K, 51Y to 51K, 52Y to 52K, 61Y to 61K, and 62Y to 62K is configured to be equal to or greater than the width of the recording region of the recording medium P, but the image-recordable width may also be smaller than the width of the recording region of the recording medium P so that the inkjet recording heads eject ink droplets while moving in a direction intersecting the relative moving direction of the recording medium.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejecting apparatus comprising:

a first liquid droplet ejecting head that is formed by joining together a plurality of units at which nozzles that eject liquid droplets are two-dimensionally arranged; and a second liquid droplet ejecting head that is formed by joining together a plurality of units at which nozzles that eject liquid droplets are two-dimensionally arranged, with an overlap width of the nozzles between units at joined portions of the units being greater in the second liquid droplet ejecting head than in the first liquid droplet ejecting head;

wherein the first liquid droplet ejecting head ejects black ink.

2. The liquid droplet ejecting apparatus of claim 1, wherein the overlap width in the first liquid droplet ejecting head is zero.

3. The liquid droplet ejecting apparatus of claim 1, wherein the second liquid droplet ejecting head ejects color ink.

4. The liquid droplet ejecting apparatus of claim 1, wherein the liquid droplet ejecting apparatus is provided with one liquid droplet ejecting head for each color.

5. The liquid droplet ejecting apparatus of claim 1, wherein the liquid droplet ejecting apparatus is provided with two liquid droplet ejecting heads for each color.

6. The liquid droplet ejecting apparatus of claim 1, further comprising an image data separating unit that separates inputted image data into line image data and character image data and into picture image data, and a control unit that causes the first liquid droplet ejecting head to eject liquid droplets on the basis of the line image data and character image data that the image data separating unit has separated and causes the second liquid droplet ejecting head to eject liquid droplets on the basis of picture image data that the image data separating unit has separated.

7. The liquid droplet ejecting apparatus of claim 6, wherein the second liquid droplet ejecting head ejects ink, and the first liquid droplet ejecting head ejects ink that is darker than the ink ejected by the second liquid droplet ejecting head.

8. The liquid droplet ejecting apparatus of claim 1, further comprising an image data extracting unit that extracts line image data and character image data from inputted image data, and a control unit that causes the first liquid droplet ejecting head to eject liquid droplets on the basis of image data that the image data extracting unit has extracted from the inputted image data and causes the second liquid droplet ejecting head to eject liquid droplets on the basis of image data that the image data extracting unit has not extracted from the inputted image data.

9. The liquid droplet ejecting apparatus of claim 1, further comprising an image data extracting unit that extracts picture image data from inputted image data, and a control unit that causes the second liquid droplet ejecting head to eject liquid droplets on the basis of image data that the image data extracting unit has extracted from the inputted image data and causes the first liquid droplet ejecting head to eject liquid droplets on the basis of image data that the image data extracting unit has not extracted from the inputted image data.

10. The liquid droplet ejecting apparatus of claim 1, wherein the first liquid droplet ejecting head is formed by arranging the units in a staggered manner, with the nozzles in each of the units being arrayed in a rectangular shape.

11. The liquid droplet ejecting apparatus of claim 1, wherein the second liquid droplet ejecting head ejects liquid droplets onto a recording medium that moves relative to the second liquid droplet ejecting head, the nozzles in each of the units are arrayed in a trapezoidal shape, and part of regions at which the nozzles are arrayed overlap between the units in a direction in which the recording medium and the second liquid droplet ejecting head relatively move.

12. The liquid droplet ejecting apparatus of claim 1, wherein the second liquid droplet ejecting head ejects liquid droplets onto a recording medium that moves relative to the second liquid droplet ejecting head, the nozzles in each of the units are arrayed in a parallelogram shape, and part of regions at which the nozzles are arrayed overlap between the units in a direction in which the recording medium and the second liquid droplet ejecting head relatively move.

* * * * *